US011547992B2

(12) United States Patent
Schraut et al.

(10) Patent No.: US 11,547,992 B2
(45) Date of Patent: Jan. 10, 2023

(54) DISPENSER FOR TAKING UP AND DISPENSING VOLUMES OF FLUID AND A METHOD FOR MOUNTING AND RELEASING A PISTON-CYLINDER UNIT FROM THE DISPENSER

(71) Applicant: BRAND GMBH + CO KG, Wertheim (DE)

(72) Inventors: Jürgen Schraut, Rettersheim (DE); Daniel Setzer, Schneeberg (DE); Renate Rempt, Wertheim (DE)

(73) Assignee: BRAND GMBH + CO KG, Wertheim (DE)

( * ) Notice: Subject to any disclaimer, the term of this patent is extended or adjusted under 35 U.S.C. 154(b) by 658 days.

(21) Appl. No.: 16/486,866

(22) PCT Filed: Feb. 20, 2018

(86) PCT No.: PCT/EP2018/054080
§ 371 (c)(1),
(2) Date: Aug. 19, 2019

(87) PCT Pub. No.: WO2018/153830
PCT Pub. Date: Aug. 30, 2018

(65) Prior Publication Data

US 2020/0171481 A1 Jun. 4, 2020

(30) Foreign Application Priority Data

Feb. 23, 2017 (DE) ..... 20 2017 101 009.0

(51) Int. Cl.
*B01L 3/02* (2006.01)

(52) U.S. Cl.
CPC ..... *B01L 3/0234* (2013.01); *B01L 3/0279* (2013.01); *B01L 2200/143* (2013.01); *B01L 2300/021* (2013.01); *B01L 2400/0478* (2013.01)

(58) Field of Classification Search
CPC ..... B01L 3/0234; B01L 3/0279; B01L 2200/143; B01L 2300/021; B01L 2400/0478; B01L 3/0217
(Continued)

(56) References Cited

U.S. PATENT DOCUMENTS 4,779,467 A * 10/1988 Rainin ..... B01L 3/0279 422/932
5,747,709 A 5/1998 Oshikubo
(Continued)

FOREIGN PATENT DOCUMENTS

DE 19917907 A1 11/2000
DE 19915771 C1 1/2001
(Continued)

*Primary Examiner* — Robert R Raevis
(74) *Attorney, Agent, or Firm* — David S. Safran; Calderon Safran & Cole P.C.

(57) ABSTRACT

A dispenser for receiving and dispensing volumes of fluid, on which a piston/cylinder unit having a piston and a cylinder, can be fitted in a releasable manner by means of a movement running at least substantially in an axial direction of the dispenser. The dispenser has a piston actuator for moving the piston relative to the cylinder. The piston actuator is arranged in a movable manner in the dispenser and is driven by means of a drive. The dispenser has a locking element which is arranged in a movable manner in the dispenser and is driven by a further drive. Also disclosed is a system for receiving and dispensing volumes of fluid, to a method for fitting a piston/cylinder unit in a releasable
(Continued)

manner on a dispenser, and to a method for releasing a piston/cylinder unit which has been fitted on a dispenser.

27 Claims, 14 Drawing Sheets

(58) Field of Classification Search
USPC ..... 73/864.14, 864.16, 864.18; 422/501, 422/521, 522
See application file for complete search history.

(56) References Cited

U.S. PATENT DOCUMENTS 5,849,248 A * 12/1998 Homberg ..... B01L 3/0224 73/864.18
7,563,409 B2 7/2009 Suovaniemi et al.
8,114,361 B2 2/2012 Reichmuth
8,570,029 B2 10/2013 Andres et al.
8,652,418 B2 * 2/2014 Rempt ..... G01F 1/8468 422/522
8,661,920 B2 * 3/2014 Molitor ..... B01L 3/0237 73/863.02
8,813,584 B2 8/2014 Blumentritt et al.
9,891,143 B2 2/2018 Ito et al.
9,925,535 B2 3/2018 Ito et al.
2005/0194407 A1 9/2005 Bach
2013/0047751 A1 2/2013 Voss et al.
2013/0239706 A1 9/2013 Link

FOREIGN PATENT DOCUMENTS

EP 2783753 A1 10/2014
JP 4884653 * 2/2012

* cited by examiner

DISPENSER FOR TAKING UP AND DISPENSING VOLUMES OF FLUID AND A METHOD FOR MOUNTING AND RELEASING A PISTON-CYLINDER UNIT FROM THE DISPENSER

BACKGROUND OF THE INVENTION

Field of the Invention

The invention relates to a dispenser for taking up and dispensing volumes of fluid on which a piston-cylinder unit having a piston and a cylinder can be releasably mounted by means of a movement at least substantially in an axial direction of the dispenser. The invention additionally relates to a system for taking up and dispensing volumes of fluid with such a dispenser, to a method for releasably mounting a piston-cylinder unit on such a dispenser, and to a method for releasing a piston-cylinder unit from such a dispenser.

Background of the Invention

The purpose of systems of the type under consideration is to take up a volume of fluid from a container and subsequently to dispense it into another, or several other containers. Such systems are used, in particular, for repeated dispensing, titrating, or pipetting, of liquids.

Such systems comprise a dispenser, and a piston-cylinder unit, realized as a replaceable part, which can be releasably mounted on the dispenser, in particular can be put into or inserted into the dispenser. Following one or more dispensing operations, the piston-cylinder unit can be released from the dispenser. Another, in particular different, piston-cylinder unit, can then be mounted on the dispenser.

Such systems may be realized as manual or motor-driven hand-held devices, on whose dispenser exactly one piston-cylinder unit can be mounted. There are also systems on whose dispenser a multiplicity of piston-cylinder units can be mounted simultaneously, such as, for example, in the case of an automatic pipetter.

Piston-cylinder units of the type under consideration may be realized, for example, as displacement units having attachable tips, or as syringes. They each have a cylinder, in particular having a straight hollow cylinder having a substantially circular cross section and an axial direction perpendicular thereto, and a piston that is displaceable in the cylinder, in the axial direction thereof. Depending on their type, piston-cylinder units have cross sections and/or lengths of differing sizes. For the purpose of identifying the respective type, they may have geometrically differing information carrier portions. Depending on the type, displacement of the piston in the cylinder may result in differing volumes of fluid being taken up into or dispensed from the cylinder or the tip attached therein. The displacement of the piston in the cylinder is a substantially linear movement in the axial direction of the cylinder.

Known from practice is a dispenser, for taking up and dispensing volumes of fluid, on which a piston-cylinder unit, having a piston and a cylinder, can be releasably mounted by means of a movement at least substantially in the axial direction of the dispenser. The known dispenser has a piston actuator for moving the piston relative to the cylinder. The piston actuator is arranged in a movable manner in the dispenser and driven by means of an electric motor. It is thus a motor-driven, electronic dispenser.

The known dispenser has a housing and a stop element, and is realized such that, when the piston-cylinder unit is being mounted on the dispenser, a fastening portion of the cylinder can abut on the stop element. The fastening portion of the cylinder is formed by a flange, i.e., by an annular widening of the cylinder, at one end of the cylinder.

The known dispenser additionally has a first fastening means for fixing the cylinder to the dispenser. The first fastening means has two cylinder gripping levers, and can be moved into a fixing position in which the first fastening means blocks a relative movement between the cylinder and the housing in the axial direction.

Furthermore, the known dispenser has a second fastening means for fixing the piston to the dispenser. The second fastening means has two piston gripping levers, and can be moved into a fixing position in which the piston is releasably connected to the piston actuator in such a manner that the piston can be moved relative to the cylinder, by means of the piston actuator, for the purpose of taking up and/or dispensing volumes of fluid.

During moving of the piston-cylinder unit in the direction of the stop element, relative to the housing of the dispenser, the first fastening means of the dispenser is moved by the flange of the cylinder out of the fixing position, such that the cylinder can be moved further toward the stop element. The cylinder gripping levers of the first fastening means in this case are forced radially outward by the flange of the cylinder. When the flange of the cylinder abuts on the stop element of the dispenser, the first fastening means of the dispenser engages, in particular by means of its cylinder gripping levers, behind the flange of the cylinder. The cylinder is thus held by positive engagement on the dispenser in the axial direction.

In addition, during moving of the piston-cylinder unit in the direction of the stop element, relative to the housing of the dispenser, the second fastening means is moved by the flange of the piston out of the fixing position, such that the piston can be moved further into the dispenser. In this case, the piston gripping levers of the second fastening means are forced radially outward by the flange of the piston. When the piston has been moved far enough into the dispenser, the second fastening means of the dispenser engages, in particular by means of its piston gripping levers, behind the flange of the piston. The piston is thus held by positive engagement on the dispenser in the axial direction. The piston gripping means are motionally coupled to the piston actuator. Accordingly, following engagement behind the flange of the piston, the piston can be moved relative to the cylinder, by means of the piston actuator, for the purpose of taking up and/or dispensing volumes of fluid.

For the purpose of releasing the piston-cylinder unit from the known dispenser, the first and the second fastening means are manually actuated in such a manner that the cylinder gripping levers and the piston gripping levers are forced radially outward, until the cylinder and the piston are no longer held by positive engagement on the dispenser. The piston-cylinder unit can then be separated from the dispenser.

SUMMARY OF THE INVENTION

It is essential for the present invention that the piston-cylinder units can be mounted on the dispenser by means of a movement at least substantially in an axial direction of the dispenser. This allows the corresponding system to be operated in a simple, user-friendly and ergonomically advantageous manner, and with a lesser susceptibility to error. The expression "axial direction of the dispenser" in this case denotes an orientation coinciding with or parallel to the longitudinal axis of the dispenser.

The present invention focuses on piston-cylinder units that operate according to the direct displacement principle, and on motor-operated, electronic multiple dispensers. In the case of such dispensers, the actuation of one or more pushbuttons activates a taking up, or aspiration, mechanism, or a dispensing mechanism. The piston of a piston-cylinder unit mounted on the dispenser is moved by means of a motor, the volume dispensing being controlled by a microprocessor. The piston tightly strips the inner wall of the cylinder of the piston-cylinder unit, such that exactly reproducible volume results are achieved.

For the systems that are relevant here, the mounting of a piston-cylinder unit on the dispenser and the releasing of this piston-cylinder unit from the dispenser are central aspects of the use of the dispenser. A further aspect are piston-cylinder units having information carrier portions, and dispensers having an acquisition device for automatically identifying, by means of the information carrier portions, the type of a piston-cylinder unit attached to the dispenser. The dispensing of volumes of fluid can then be controlled on the basis of the identified type.

An object of the present invention is to improve the known dispenser, or the known system, or the known method, for releasably mounting the piston-cylinder unit on the known dispenser, or the known method for releasing a piston-cylinder unit mounted on the dispenser, in respect of handling and/or stability when the piston-cylinder unit is being mounted and/or released, and/or in respect of accuracy when volumes of fluid are being taken up and dispensed, and/or in respect of the structure, reliability and/or durability.

According to a first aspect of the invention, the previously stated object is achieved by the dispenser as claimed in claim 1. Preferred designs of this aspect of the invention are provided by the dependent claims relating thereto.

It goes without saying that designs, embodiments, advantages and the like that, in the following, are cited only in relation to one aspect of the invention, in order to avoid repetitions, apply correspondingly in relation to the other aspects of the invention.

On this basis, the present invention is described in greater detail in the following.

The basis of the first aspect of the invention is a dispenser, for taking up and dispensing volumes of fluid, on which a piston-cylinder unit, having a piston and a cylinder, can be releasably mounted by means of a movement at least substantially in the axial direction of the dispenser. The dispenser has a piston actuator for moving the piston relative to the cylinder. The piston actuator is arranged in a movable manner in the dispenser and driven by means of a drive.

According to the invention, the dispenser has a locking element, which is arranged in a movable manner in the dispenser and driven by means of a drive. The drive of the locking element is separate from the drive of the piston actuator.

Preferably, the locking element is arranged so as to be movable in the axial direction, and can be moved into different positions. Further elements, or means, of the dispenser, explained in the following, can be moved as a result of the locking element being moved. The further elements, or means, in this case are not necessarily moved by the locking element itself. However, moving of the locking element causes the other elements, or means, to be moved. Thus, moving of the locking element may have the effect, for example, that an element that was previously blocked in respect of movement is moved with or following the moving of the locking element, the moving of this element being able to be effected, for example, by the spring force of a spring element. It is preferred, however, if the locking element, as a result of its movement, itself moves a further element, or a further means.

It is advantageous in this case that the elements, or means, do not have to be moved manually, but are moved automatically at the instigation of a user and/or a control means of the dispenser. This provides for convenient handling of the dispenser.

Preferably, the drive of the locking element is an electric stepper motor. Advantageously, the locking element is driven, by means of its drive, via a self-arresting gear unit.

In a preferred design, the dispenser has a housing, a stop element, and a first fastening means for fixing the cylinder to the dispenser. The stop element is movable at least substantially in the axial direction, relative to the housing, and can be pressed relative to the housing, at least partly, in the direction of mounting. This enables the cylinder to be moved further in the direction of mounting, relative to the housing, after the fastening portion of the cylinder abuts on the stop element. Further pressing of the cylinder during mounting of the piston-cylinder unit is thus possible.

The dispenser is realized such that, during mounting of the piston-cylinder unit on the dispenser, a fastening portion of the cylinder can abut on the stop element. The first fastening means can be moved into a fixing position in which the first fastening means blocks a relative movement between the cylinder and the housing, counter to the direction of mounting.

In the case of this design, the locking element can be moved into a locking position in which the locking element blocks a relative movement between the stop element and the housing, in the direction of mounting. The stop element can thus be locked. A relative movement between the stop element and the housing in the axial direction is blocked, on the one hand, by the locking element, and on the other hand by the first fastening means, i.e., is not possible. In this state, when the piston is being displaced in the cylinder, in the direction of mounting, in particular when a viscous or highly viscous liquid is being taken up, the fastening portion is prevented from moving the stop element in the direction of mounting in such a manner that the cylinder slips, or a delay is caused, as a result of which the desired volume of fluid to be taken up differs from the volume of fluid actually taken up. This results in increased accuracy in the taking up and dispensing of volumes of fluid.

In particular, when the locking element is in the locking position, the fastening portion of the cylinder can be clamped between the first fastening means and the stop element, in such a manner that a relative movement between the cylinder and the housing is blocked in the axial direction, and optionally in the radial direction and/or circumferential direction.

Preferably, the dispenser has means for mechanically, electronically, inductively and/or optically detecting the mounting of a piston-cylinder unit on the dispenser. This detection enables further steps to be triggered, e.g., moving of the locking element.

For this purpose, the dispenser may have an optical, electronic, mechanical, magnetoresistive and/or inductive sensor means, by means of which the moving of the stop element in the axial direction can be detected. The sensor means may have, for example, a light barrier, having a light-beam source and a sensor for detecting light beams of the light-beam source, the light barrier being arranged such that moving of the stop element in the axial direction can be detected by the light barrier.

It has proved to be advantageous if the dispenser has a reset means, which exerts a resetting force upon the stop element, at least substantially in the axial direction, counter to the direction of mounting. If the fastening portion of the cylinder abuts on the stop element and the locking element is not in its locking position, moving the cylinder further in the direction of mounting, relative to the housing, must be performed against the resetting force of the reset means. As a result, tolerances of the stop element of the dispenser, or of the fastening portion of the cylinder, are compensated, and damage to the dispenser, or cylinder, or effects of wear thereof, are avoided, or at least reduced.

Preferably, the stop element is mounted in a pivotable, or tiltable, manner on the dispenser, in particular on precisely one bearing. The pivot axis or tilt axis may be oriented such that it is perpendicular and skew in relation to the longitudinal axis of the dispenser. It is preferred if the reset means is arranged, in the radial direction, diametrically opposite the precisely one bearing of the stop element.

In a preferred design, the stop element extends in the circumferential direction and/or has a passage opening for the piston.

Advantageously, the reset means has a spring element, in particular precisely one spring element, the spring force of which acts as a retting force of the reset means upon the stop element. This enables the reset means to be realized in a simple, robust, reliable and inexpensive manner.

It may be provided, moreover, that the reset means has a bolt around which the spring element extends. The pin and/or the spring element may be supported against the housing of the dispenser. The stop element may be arranged on the bolt such that it is guided along the bolt when the stop element is being moved.

It is preferred if the dispenser and its reset means are realized such that a piston-cylinder unit mounted on the dispenser can be separated from the dispenser by means of the reset means. The reset means thus facilitates automatic separation, or ejection, of the piston-cylinder unit from the dispenser after the first fastening means has been moved, out of its fixing position, into a release position in which a relative movement can be executed between the cylinder and the housing, counter to the direction of mounting. In addition, the dispenser is realized such that, when the first fastening means is in the release position, the piston-cylinder unit can be separated, or ejected, in an unimpeded manner from the dispenser.

In a further preferred design, the dispenser has a housing, and a first fastening means for fixing the cylinder to the dispenser. The first fastening means can be moved into a fixing position in which the first fastening means blocks a relative movement between the cylinder and the housing, counter to the direction of mounting.

In the case of this design, as a result of moving of the locking element, in particular in the axial direction, the first fastening means of the dispenser can be moved from its fixing position into a release position in which a relative movement between the cylinder and the housing can be executed, counter to the direction of mounting. When the locking element is in the release position, the movement capability of the stop element is thus uninfluenced by the locking element.

The dispenser according to the invention provides for ease of handling, in particular convenient release and/or separation of a piston-cylinder unit from the dispenser.

Preferably, the first fastening means has at least two pivotably mounted cylinder gripping levers, which, when the first fastening means is in the fixing position, can engage behind the fastening portion of the cylinder.

In a further preferred design, the dispenser has a second fastening means for fixing the piston to the dispenser. The second fastening means can be moved into a fixing position in which the piston is releasably connected to a piston actuator of the dispenser in such a manner that the piston can be moved relative to the cylinder, by means of the piston actuator, for the purpose of taking up and/or dispensing volumes of fluid. For this purpose, the second fastening means may have at least two pivotably mounted piston gripping levers.

In the case of this design, as a result of moving of the locking element, the second fastening means can be moved from its fixing position into a release position and vice versa, wherein the piston is not connected to the piston actuator when the second fastening means is in the release position.

Preferably, the second fastening means is motionally coupled to the piston actuator and, in its fixing position, can be guided, over the entire travel that it can execute during the moving of the piston actuator, by the locking element in such a manner that it remains in its fixing position.

Preferably, the second fastening means has two pivotably mounted piston gripping levers having cutting rollers, wherein the piston can be gripped by means of the piston gripping levers during moving the second fastening means into its fixing position. Each piston gripping lever in this case may have a positioning head, by means of which the respective piston gripping lever can be pivoted. During moving of the locking element and/or of the piston actuator, each positioning head is guided on a guide contour of the locking element. Advantageously, the extent of the guide contour in the axial direction is greater than the stroke that can be executed by the piston actuator. This prevents release of the second fastening means, in particular as a result of turning of the piston-cylinder unit.

In a further preferred design, the dispenser has an acquisition device for automatically identifying the type of a piston-cylinder unit mounted on the dispenser. The acquisition device has a radial information reader, by means of which information of a radially oriented information carrier portion of the piston-cylinder unit can be acquired. Alternatively or additionally, the acquisition device has an axial information reader, by means of which information of an axially oriented information carrier portion of the piston-cylinder unit can be acquired.

In the case of this design, at least a part of the radial information reader and/or at least a part of the axial information reader can be moved as a result of moving of the locking element.

Preferably, as a result of moving of the locking element, at least a part of the radial information reader can be inserted in the radial direction into a recess, extending in the radial direction, on a piston head of the piston-cylinder unit, and/or at least a part of the axial information reader can be inserted in the axial direction into a recess, in particular a groove, extending in the axial direction, in an end face of the piston head of the piston-cylinder unit.

In particular, the axial information reader has an acquisition element that can be inserted in the axial direction, at least partly, into the axially oriented recess. The dispenser has means by which the depth of the recess can be determined. The depth of the recess specifies the type of the piston-cylinder unit, at least partly. The term "type" in this case denotes, for example, a purpose, a state and/or a property of the piston-cylinder unit such as, for example, the maximum fluid volume that can be taken up and/or dispensed.

The expression "axially oriented recess" in this case is to be understood such that this recess is accessible in the axial direction of the piston-cylinder unit and/or the information thereof can be acquired in the axial direction of the piston-cylinder unit. The axially oriented recess has a geometric extent, in the axial direction of the piston-cylinder unit, by means of which the information of the axially oriented recess that can be acquired is coded. Moreover, the axially oriented recess has a geometric extent in the radial direction of the piston-cylinder unit and in the circumferential direction of the piston-cylinder unit.

The term "groove" is to be understood such that the recess extending in the axial direction of the piston-cylinder unit is not completely surrounded by piston material in the radial direction of the piston-cylinder unit, but is partly open in the radial direction, preferably along the entire depth of the recess. Such a design facilitates cleaning of the recess, and offers the possibility of ease of control.

Preferably, the acquisition element is realized in the manner of a plunger and/or in the shape of a pin and/or is spring-loaded, in particular elastically biased against the direction of mounting of the piston-cylinder unit. It is particularly preferred if the acquisition element can be moved into a release position as a result of moving of the locking element, and can be held, or blocked, there. As soon as the locking element no longer blocks the acquisition element, the spring-loaded acquisition element is moved toward the piston, and finally pressed into the recess of the piston that extends in the axial direction.

Preferably, the piston actuator can be moved onto the piston, in particular a piston head of the piston, until a stop of the piston actuator abuts on an end face of the piston. This movement, also referred to as block travel, serves to acquire a piston-side reference point. The piston-side reference point marks, in particular, the starting point of a determination of the depth of the axially oriented recess of the piston.

Preferably, the locking element is driven by means of a first motor, and/or the piston actuator is driven by means of a second motor. In particular, the first motor has a lesser nominal output power than the second motor.

Preferably, the dispenser according to the invention is a fully autonomous hand-held device that, irrespective of location, combines all components in one housing. These include, as usual, a gear unit, which converts the rotary motion of the drive into a longitudinal movement of the piston actuator, and a set of electronics and an electric power supply.

According to a second aspect of the invention, the previously stated object is achieved by a system for taking up and dispensing volumes of fluid.

The system according to the second aspect of the invention has a piston-cylinder unit, realized as a replacement part, and a dispenser as previously described. The piston-cylinder unit can be releasably mounted on the dispenser by means of a movement at least substantially in the axial direction, and has a piston and a cylinder that has a fastening portion.

A further aspect relates to a method for releasably mounting a piston-cylinder unit on a dispenser. The piston-cylinder unit has a piston and a cylinder that has a fastening portion. The dispenser has a housing, a stop element, a first fastening means, for fixing the cylinder to the dispenser, and a locking element. In particular, the dispenser is realized as described further above.

The method comprises the following method steps:

a) placing the fastening portion of the cylinder of the piston-cylinder unit against the stop element of the dispenser by means of a movement at least substantially in the axial direction of the dispenser, b) moving the first fastening means of the dispenser into a fixing position, as a result of which the cylinder of the piston-cylinder unit is fixed to the dispenser by means of the first fastening means of the dispenser, such that a relative movement between the cylinder of the piston-cylinder unit and the housing of the dispenser is blocked counter to the direction of mounting, and optionally in the radial direction, and c) moving the locking element by means of a drive.

It may be provided in step a) that the piston is moved through a passage opening of the stop element. In order not to impede further pressing of the piston-cylinder unit, a piston actuator of the dispenser may be moved into a release position before step a).

Preferably, in step b) the first fastening means, in the fixing position, engages behind the fastening portion of the cylinder by means of at least two pivotably mounted cylinder gripping levers.

Preferably, the dispenser has an acquisition device, for automatically identifying a type of a piston-cylinder unit mounted on the dispenser. The acquisition device has a radial information reader, by means of which information of a radially oriented information carrier portion of the piston-cylinder unit can be acquired. Alternatively or additionally, the acquisition device has an axial information reader, by means of which information of an axially oriented information carrier portion of the piston-cylinder unit can be acquired. According to the method, it may now be provided that, in step c), as a result of moving of the locking element, at least a part of the radial information reader can be inserted in the radial direction into a radially oriented recess on a piston head of the piston-cylinder unit, and/or at least a part of the axial information reader can be inserted in the axial direction into an axially oriented recess, in particular a groove, in an end face of the piston head of the piston-cylinder unit.

Preferably, moving of the stop element in the direction of mounting is detected mechanically, electronically, inductively and/or optically, preferably by means of a light barrier.

In the case of a preferred embodiment of the method, in step c) the locking element of the dispenser is moved, preferably in the axial direction, into a locking position in which a relative movement between the stop element and the housing is blocked in the direction of mounting. This step may be performed automatically by the dispenser following a detection of a movement of the stop element in the direction of mounting. When the locking element is in the locking position, the fastening portion of the cylinder is clamped between the first fastening means and the stop element, such that a relative movement between the cylinder and the housing is blocked in the axial direction, and optionally in the radial direction and/or circumferential direction. The cylinder is thus held by positive engagement—between the stop element and the fastening means—on the dispenser.

It may be provided that, for the purpose of fixing the piston to the dispenser, as a result of moving of the locking element a second fastening means of the dispenser is moved into a fixing position in which the piston is releasably connected to a piston actuator of the dispenser in such a manner that, for the purpose of taking up and/or dispensing volumes of fluid, the piston can be moved relative to the cylinder by means of the piston actuator.

Advantageously, the locking element is moved by means of a first motor, and/or the piston actuator is moved by means of a second motor. The movements may be triggered upon an input by a user, or automatically by the dispenser.

For the purpose of taking up or dispensing a volume of fluid, a relative movement between the piston and the cylinder may be generated by means of the piston actuator. In this case, the path travelled by the piston relative to the housing of the dispenser may be determined incrementally, and/or the absolute travel position of a position element of the dispenser, which is motionally coupled to the piston actuator, may be acquired.

In the case of a preferred embodiment of the method, a reference point on the piston is acquired by moving the piston actuator of the dispenser toward the piston until a stop of the piston actuator abuts on an end face of the piston. The distance travelled by the piston actuator can then be determined, in particular by a means for incremental distance measurement.

Preferably, an acquisition element of the dispenser is inserted in the axial direction, at least partly, into an axially oriented recess in an end face of the piston, and the depth of this recess is determined. The determined depth value can be used to identify the type of the piston-cylinder unit.

A further aspect relates to a method for releasing a piston-cylinder unit mounted on a dispenser. The piston-cylinder unit has a piston and a cylinder. The dispenser has a housing, a first fastening means, for fixing the cylinder to the dispenser, and a locking element. In particular, the dispenser is realized as described further above.

The method comprises the following method steps:

moving the locking element by means of a drive, moving the first fastening means out of a fixing position, in which the first fastening means blocks a relative movement between the cylinder and the housing, counter to the direction of mounting, into a release position, in which a relative movement between the cylinder and the housing can be executed, counter to the direction of mounting, and moving the cylinder relative to the housing, counter to the direction of mounting.

Preferably, as a result of the moving of the locking element, a second fastening means of the dispenser is moved out of a fixing position, in which the piston is releasably connected to a piston actuator of the dispenser in such a manner that, for the purpose of taking up and/or dispensing volumes of fluid, the piston can be moved relative to the cylinder by means of the piston actuator, into a release position, in which the piston is not connected to the piston actuator.

Preferably, the piston-cylinder unit is separated from the dispenser by the resetting force of a reset means of the dispenser upon a stop element of the dispenser.

The invention is explained in greater detail in the following on the basis of the description of preferred exemplary embodiments, in part with reference to the drawing. The features described above and/or in the description that follows may be combined with each other as may be required, but may also be realized independently of each other, even if this is not expressly described in detail.

DETAILED DESCRIPTION OF THE INVENTION

Figure 1:
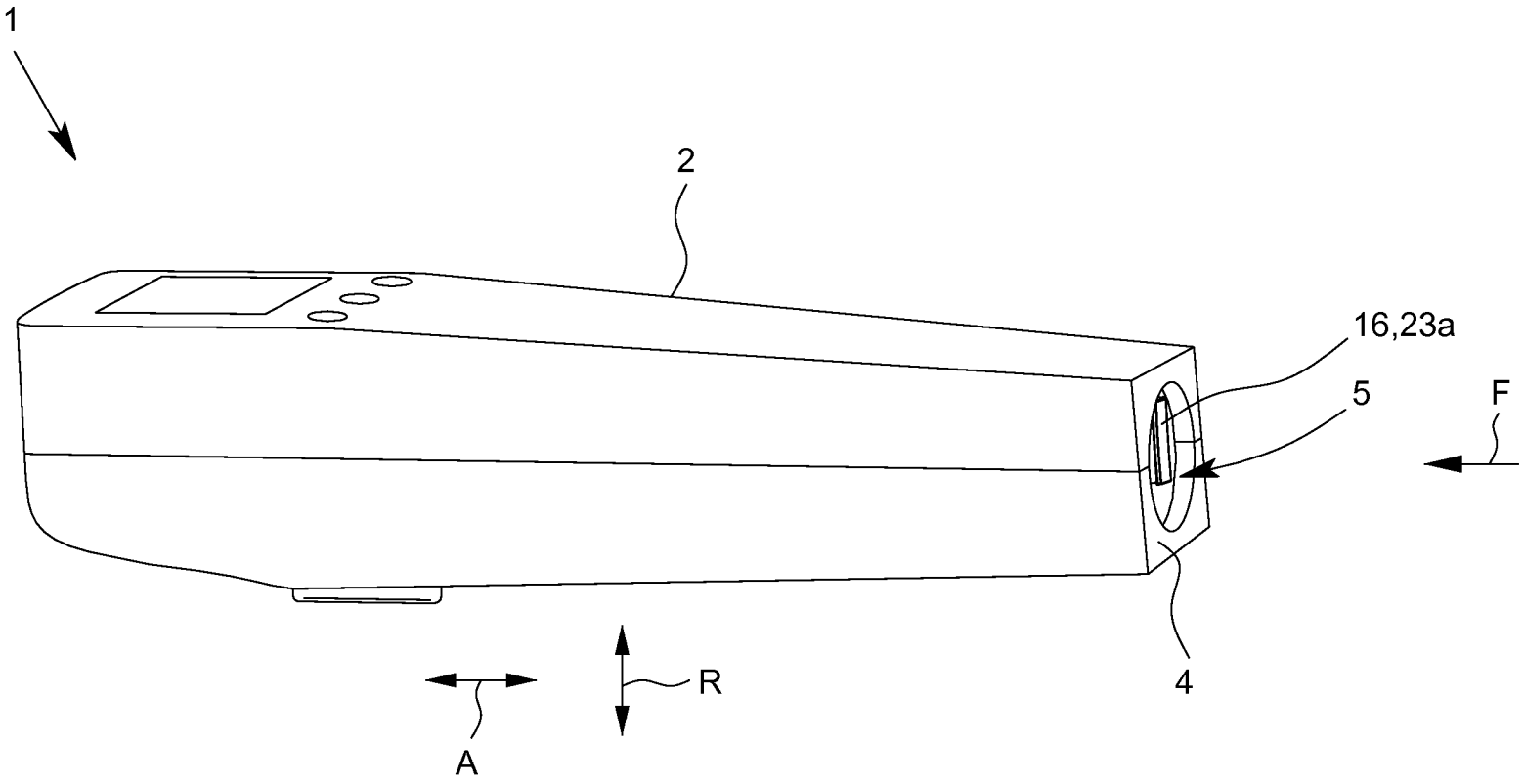
FIG. 1 is a schematic perspective view of a preferred embodiment of a dispenser according to the invention.

Shown schematically in FIG. 1 is a perspective view of a preferred embodiment of a dispenser 1 according to the invention for taking up and dispensing volumes of fluid. The dispenser 1 has a housing 2, an axial direction A and a radial direction R.

A piston-cylinder unit 3 can be releasably mounted on the dispenser 1 by means of a movement at least substantially in the axial direction A of the dispenser 1. For this purpose, on an underside 4 the dispenser 1 has an opening 5 for receiving a part of the piston-cylinder unit 3.

The term "direction of mounting" denotes a direction, at least substantially in the axial direction A of the dispenser 1, toward the opening 5 of the dispenser 1, thus from right to left in FIG. 1. In FIG. 1 the direction of mounting F is indicated by an arrow.

Figure 2:
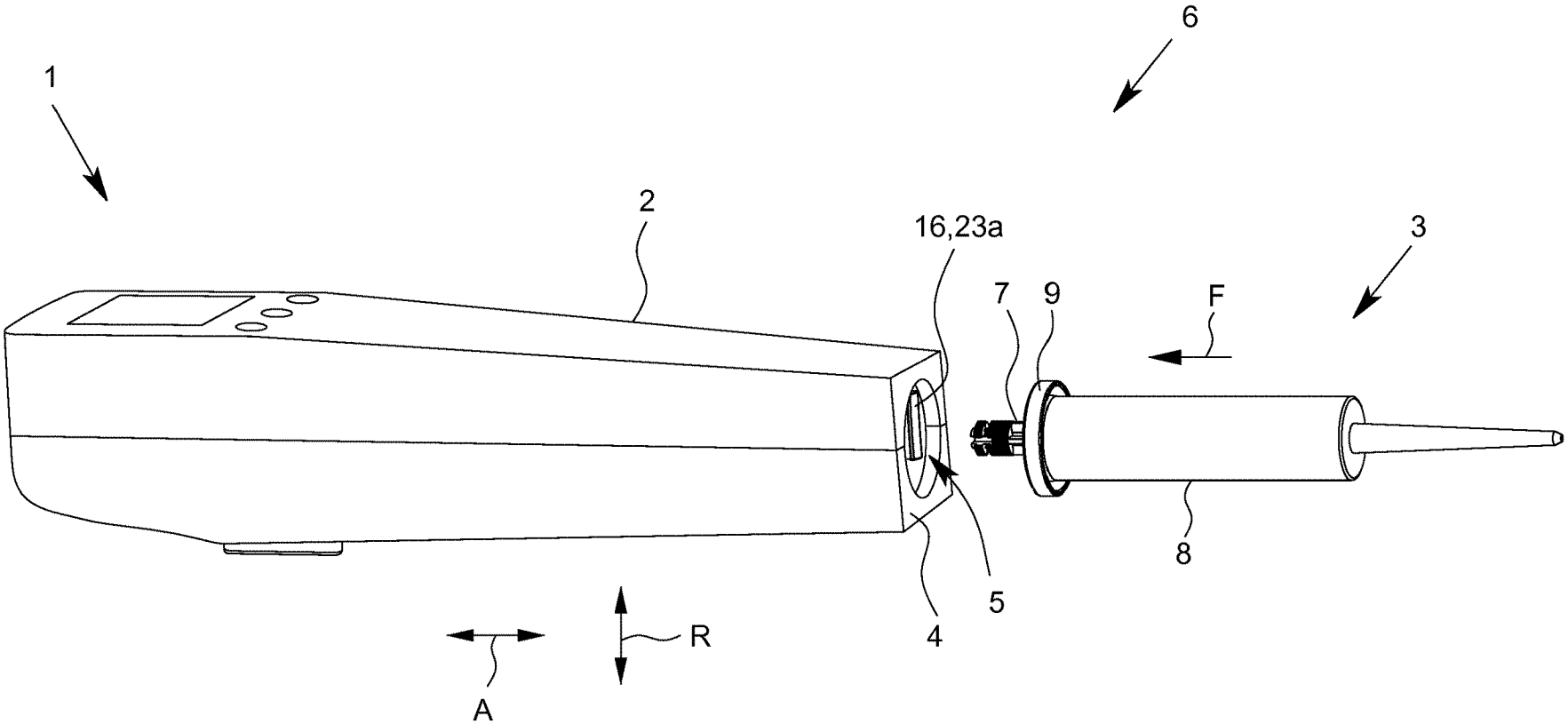
FIG. 2 is a schematic perspective view of a preferred embodiment of a system according to the invention with the dispenser from FIG. 1 and a piston-cylinder unit in an initial state.

Shown schematically in FIG. 2 is a perspective view of the dispenser 1 from FIG. 1 and of a piston-cylinder unit 3, as parts of a preferred embodiment of a system 6 according to the invention for taking up and dispensing volumes of fluid.

The piston-cylinder unit 3 is realized as a replacement part. It may be realized in the form of a syringe, and exist in various sizes having differing receiving volumes. It has a sealed piston 7, which can be moved in a cylinder 8 of the piston-cylinder unit 3 for the purpose of taking up, or aspirating, and dispensing, or ejecting, a fluid to be pipetted or dosed. The cylinder 8 has a fastening portion 9, which here is formed by a flange, thus an annular widening of the cylinder 8, and specifically at that end of the cylinder 8 from which the piston 7 projects out of the cylinder 8. The flange 9 has a U-shaped profile in longitudinal section, thus being similar to a collar.

Figure 3:
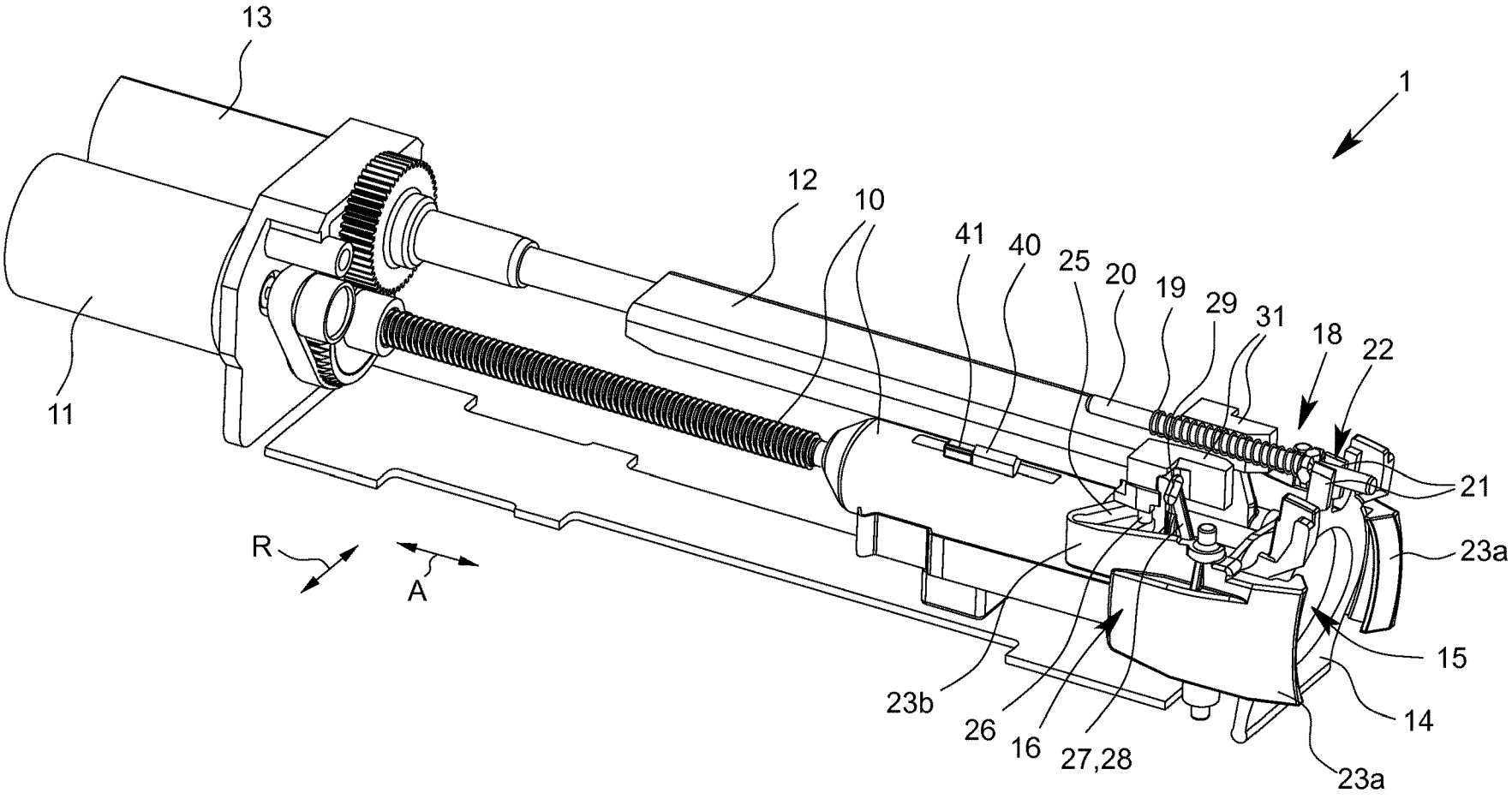
FIG. 3 is a schematic perspective view of a part of the dispenser from FIG. 1, a simplified representation having been selected, with parts of the dispenser having been omitted.
Figure 4:
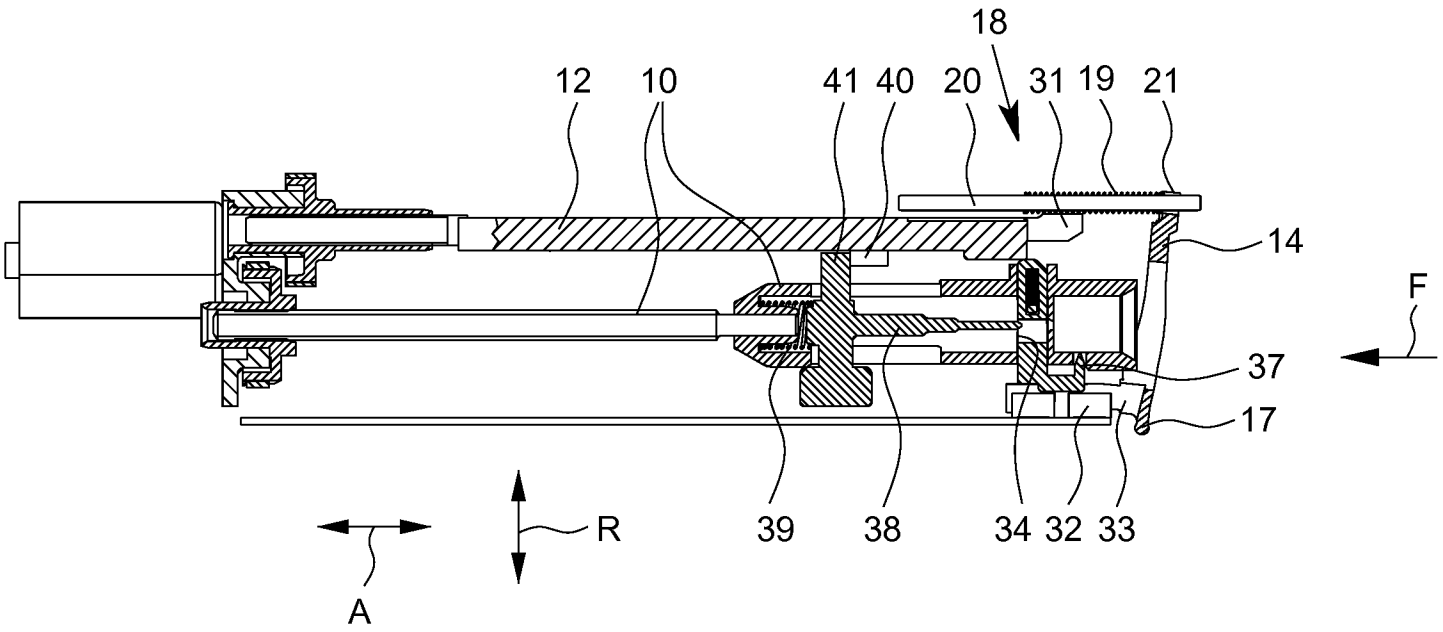
FIG. 4 is a schematic vertical longitudinal section through the dispenser from FIG. 3.

FIGS. 3 and 4 show differing views of a part of the dispenser 1 from FIG. 1. FIGS. 5 to 14 show various views of the system 6 from FIG. 2 in differing states. In FIGS. 3 to 14, the dispenser 1 is represented only partially. This is because FIGS. 3 to 14 are limited to the representation of those components that in each case are necessary for explaining the present invention. In the case of the vertical longitudinal sections, the system from FIG. 2 is cut along a plane that intersects the plane of the drawing in a vertical straight line (in a state other than the initial state). In the case of the horizontal longitudinal sections, the system from FIG. 2 is cut along a plane that intersects the plane of the drawing in a horizontal straight line (in a state other than the initial state).

The dispenser 1 has a piston actuator 10 for moving the piston 7 relative to the cylinder 8. The piston actuator 10 is arranged in a movable manner in the dispenser 1 and is driven by means of a first drive 11, namely a motor 11.

The dispenser has a locking element 12, which is arranged in a movable manner in the dispenser 1 and is driven by means of a second drive 13. The second drive 13 of the locking element 12 is separate from the first drive 11 of the piston actuator 10.

In the case of the preferred exemplary embodiment represented here, the second drive 13 of the locking element 12 is an electric stepper motor. The locking element 12 is driven, by means of its drive 13, via a self-arresting gear unit G. Here, the motor 13 has a lesser nominal output power than the motor 11 of the piston actuator 10. This enables less expensive realization.

In the case of the preferred exemplary embodiment represented here, the locking element 12 is arranged so as to be movable in the axial direction A, and can be moved into different positions. FIG. 3 shows the locking element 12 in its initial position.

In the case of the preferred exemplary embodiment represented here, the dispenser 1 has a stop element 14, having a passage opening 15 for the piston 7, and a first fastening means 16 for fixing the cylinder 8 to the dispenser 1. The stop element 14 is movable relative to the housing 2, at least substantially in the axial direction A, and can be pressed relative to the housing 2, at least partly, in the direction of mounting F.

Here, the dispenser 1 is realized such that, during mounting of the piston-cylinder unit 3 on the dispenser 1, the fastening portion 9 of the cylinder 8, specifically an abutment surface of this fastening portion 9, can abut on the stop element 14.

The first fastening means 16 can be moved into a fixing position in which the first fastening means 16 blocks a relative movement between the cylinder 8 and the housing 2, counter to the direction of mounting F.

The locking element 12 in this case can be moved into a locking position in which the locking element 12 blocks a relative movement between the stop element 14 and the housing 2, in the direction of mounting F. The stop element 14 can thus be locked. In this state, a relative movement of the cylinder 8 in the axial direction A is blocked, on the one hand, by the locking element 12 (in the direction of mounting F) and, on the other hand, by the first fastening means 16 (counter to the direction of mounting F).

When the locking element 12 is in the locking position, the fastening portion 9 of the cylinder 8 can be clamped between the first fastening means 16 and the stop element 14 in such a manner that a relative movement between the cylinder 8 and the housing 2 is blocked in the axial direction A and in the radial direction R and in the circumferential direction. The cylinder 8 is thus held by positive engagement—between the stop element 14 and the fastening means 16—on the dispenser 1.

In the case of the preferred exemplary embodiment represented here, the stop element 14 is pivotably mounted on the dispenser 1, specifically on a bearing 17. The pivot axis is oriented such that it is perpendicular to the longitudinal axis of the dispenser 1. If the abutment surface of the fastening portion 9 of the cylinder 8 is taken as a notional annulus, then the pivot axis extends as a passant radially outside of the annulus, parallel to the annulus and in the direction of mounting F above the annulus, and perpendicular to the axial direction A. In FIG. 4, the pivot axis is perpendicular to the plane of the drawing.

In the case of the preferred exemplary embodiment presented here, the dispenser 1 additionally has a reset means 18, which exerts a resetting force upon the stop element 14, at least substantially in the axial direction A, counter to the direction of mounting F. The reset means 18 is arranged, in the radial direction R, diametrically opposite the bearing 17 of the stop element 14. Here, the reset means 18 has precisely one spring element 19, the spring force of which acts as a resetting force upon the stop element 14.

For this purpose, the reset means 18 has a bolt 20 as a guide for the spring element 19. The bolt 20 extends in the axial direction A. The stop element 14 is arranged on the bolt 20 such that, during moving of the stop element 14, it is guided along the bolt 20. For this purpose, the stop element 14 has a lateral extension 21 that has a recess 22 for the bolt 20. The spring element 19 is supported on the extension 21 and against the housing 2.

Specifically, the stop element 14 can be moved, by application of force in the direction of mounting F—e.g., by a user who places a piston-cylinder unit 3 onto the stop element 14 and then presses further in the direction of mounting F—in this same direction, and counter to the resetting force. If the application of force ceases—e.g., because the user is no longer pressing further—the reset means 18 resets the stop element 14, counter to the direction of mounting F, in particular by means of the spring force of the spring element 19. This movement, however, is blocked by the fastening portion 9 of the cylinder 8, held by the first fastening means 16 in its fixing position.

Figure 11:
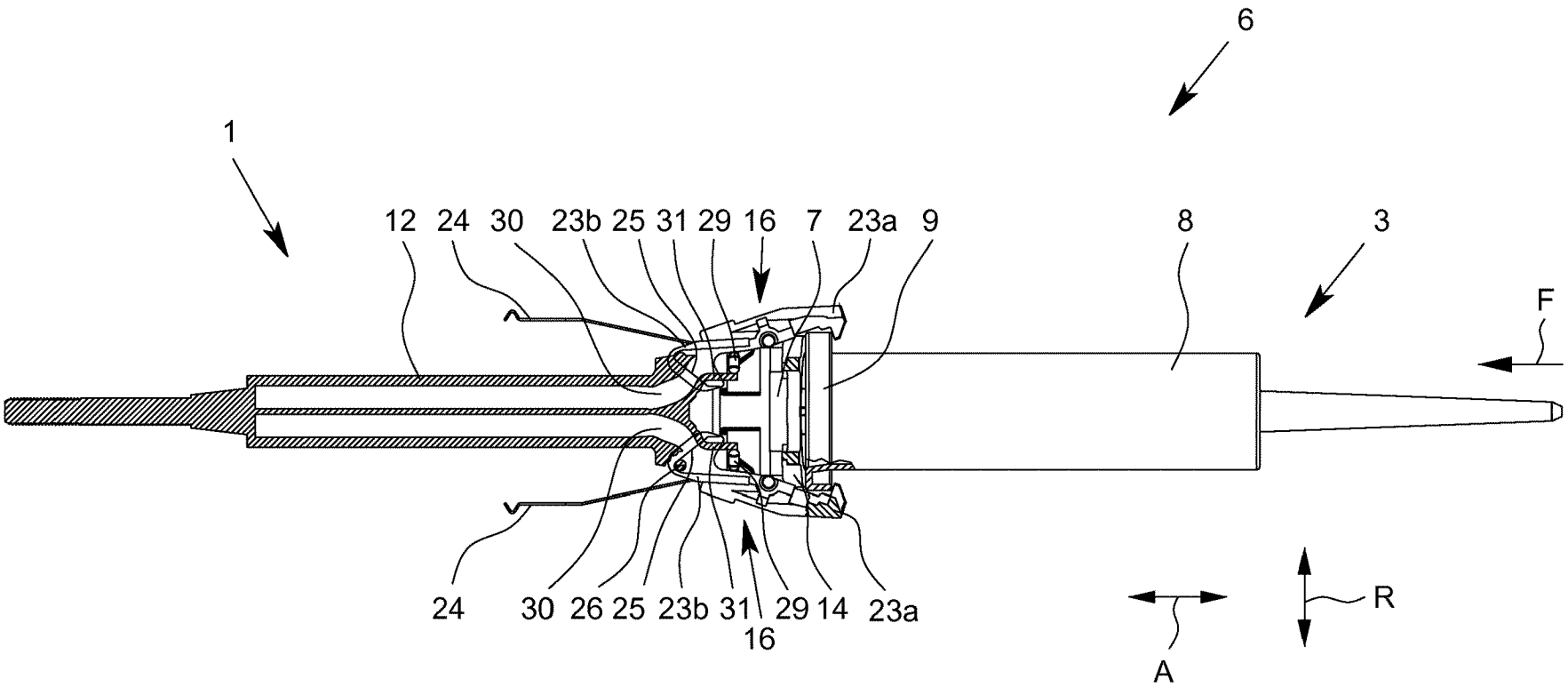
FIG. 11 is a schematic horizontal longitudinal section through the system from FIG. 3, in a seventh state.
Figure 12:
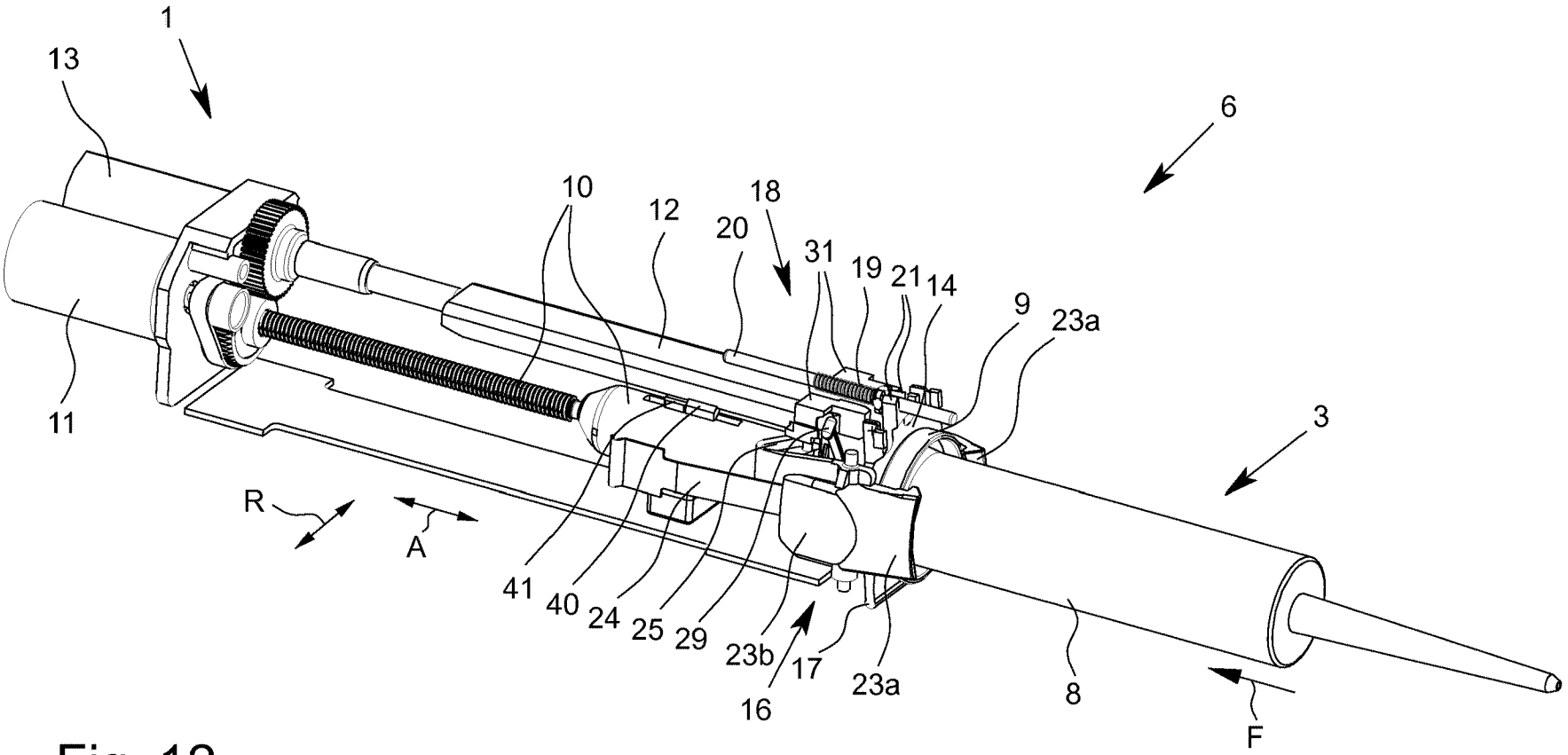
FIG. 12 is a schematic perspective view of the system from FIG. 5, in a third state.
Figure 13:
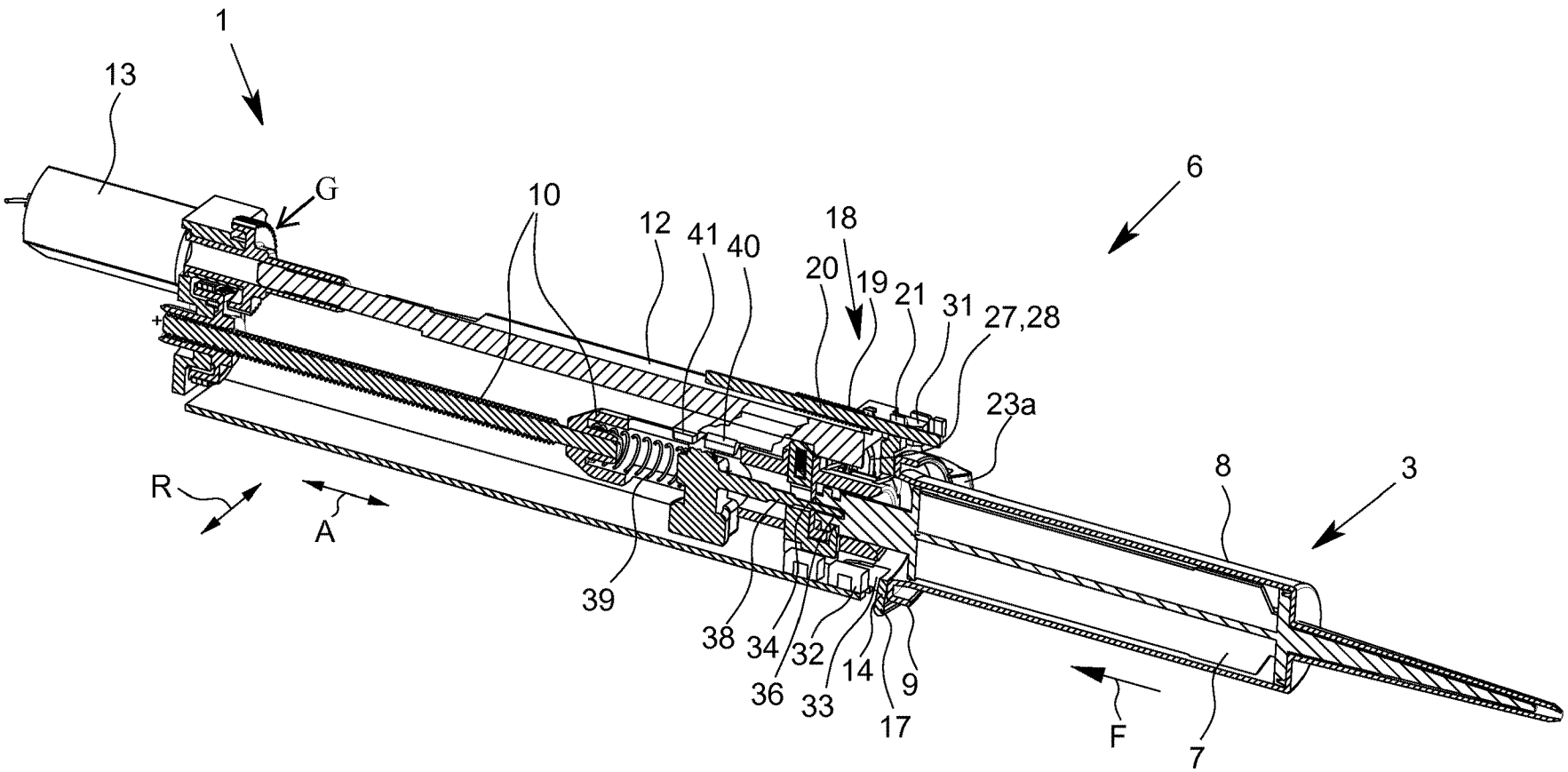
FIG. 13 is a schematic perspective view of the system from FIG. 5, in the fifth state, the system being represented partly in section.
Figure 14:
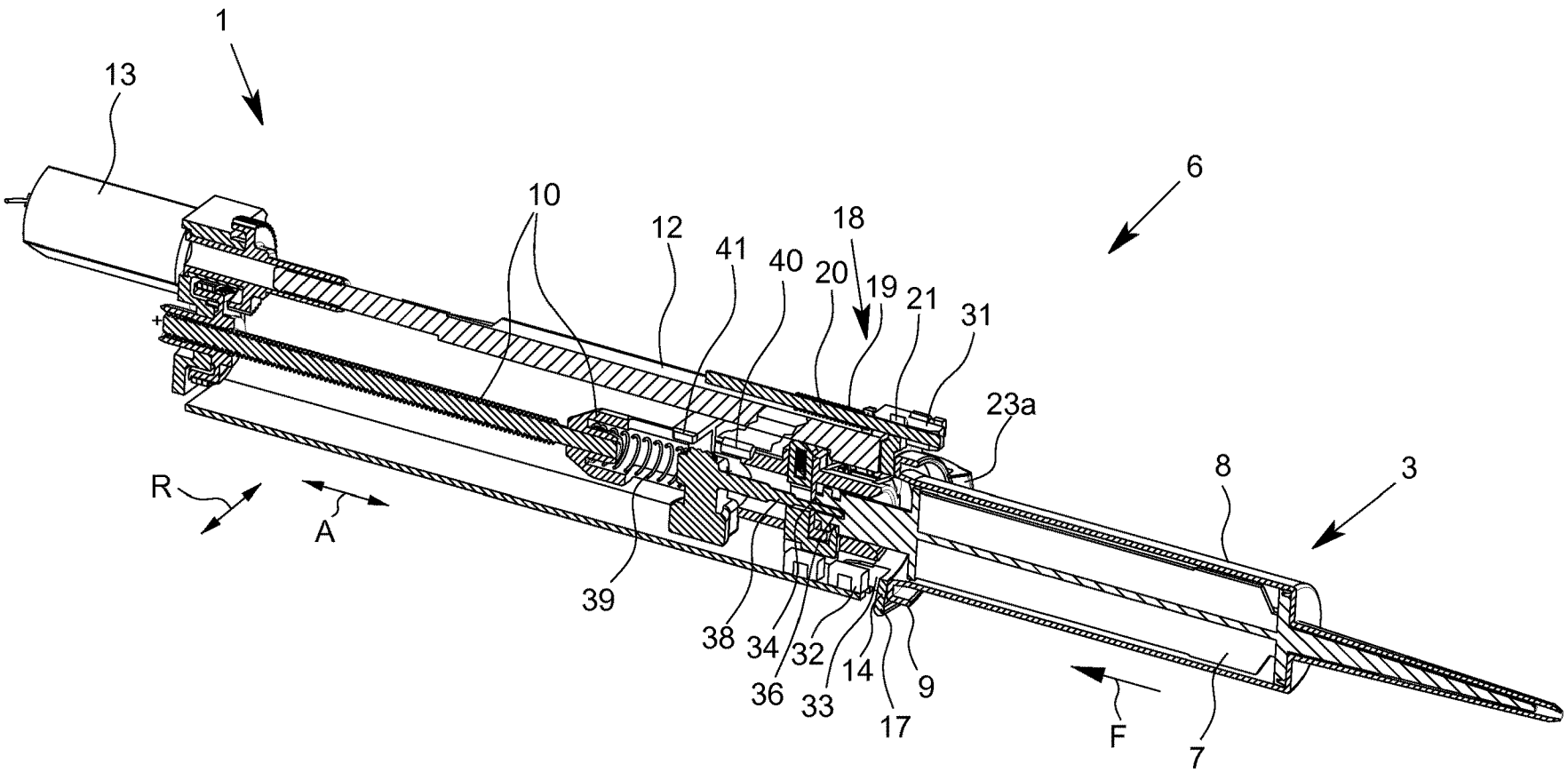
FIG. 14 is a schematic perspective view of the system from FIG. 5, in the sixth state, the system being represented partly in section.

In the case of the preferred exemplary embodiment represented here, the first fastening means 16 can be moved from its fixing position into a release position for the fastening portion 9 by moving of the locking element 12 in the direction of mounting F. In this release position, a relative movement, between the cylinder 8 and the housing 2, can be executed, counter to the direction of mounting F. If the locking element 12 is not in its locking position, it releases the movement capability of the stop element 14. This is an important function for releasing a piston-cylinder unit 3 from the dispenser 1. This release position of the first fastening means 16 (seventh state) is represented in FIG. 11, the longitudinal section in FIG. 11 extending through the locking element 12.

Figure 5:
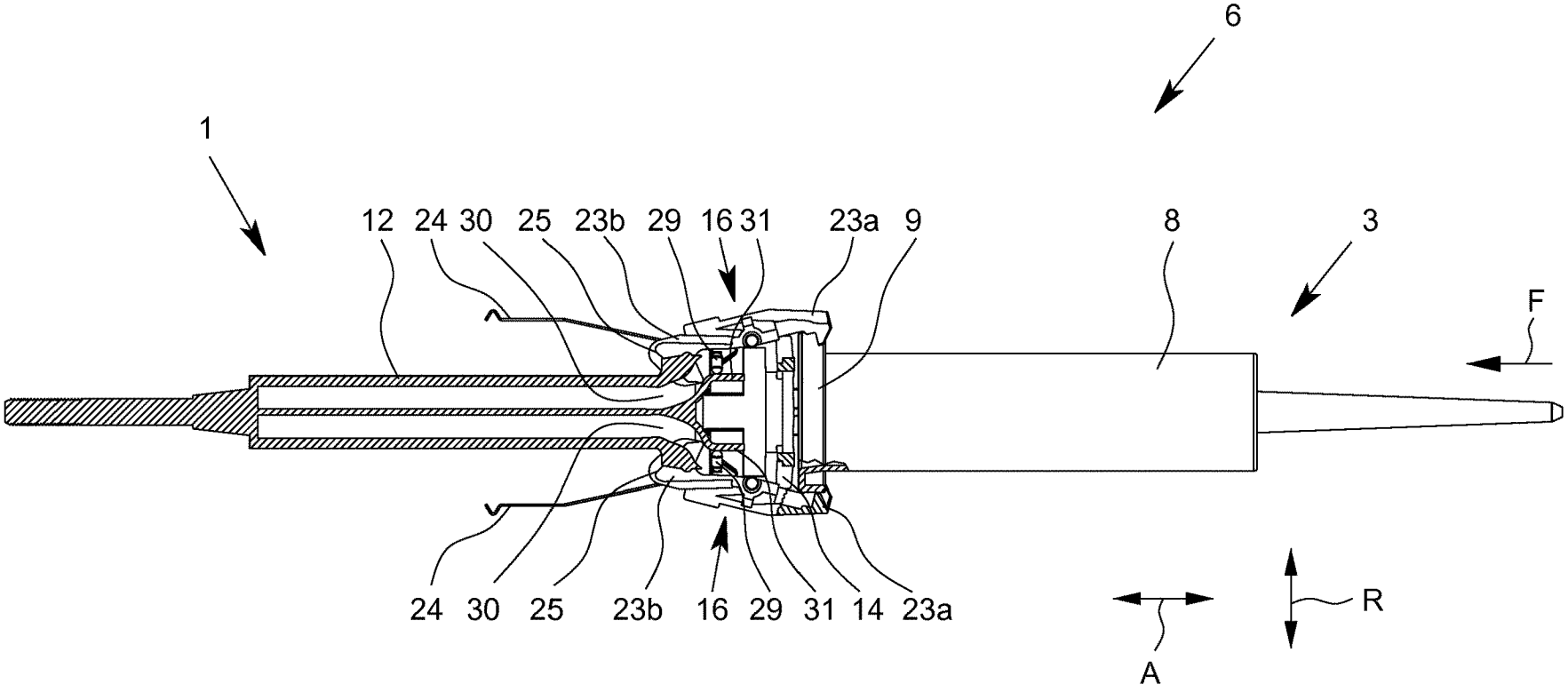
FIG. 5 is a schematic horizontal longitudinal section through the system from FIG. 2, in a first state, a simplified representation having been selected, with parts of the dispenser having been omitted.
Figure 6:
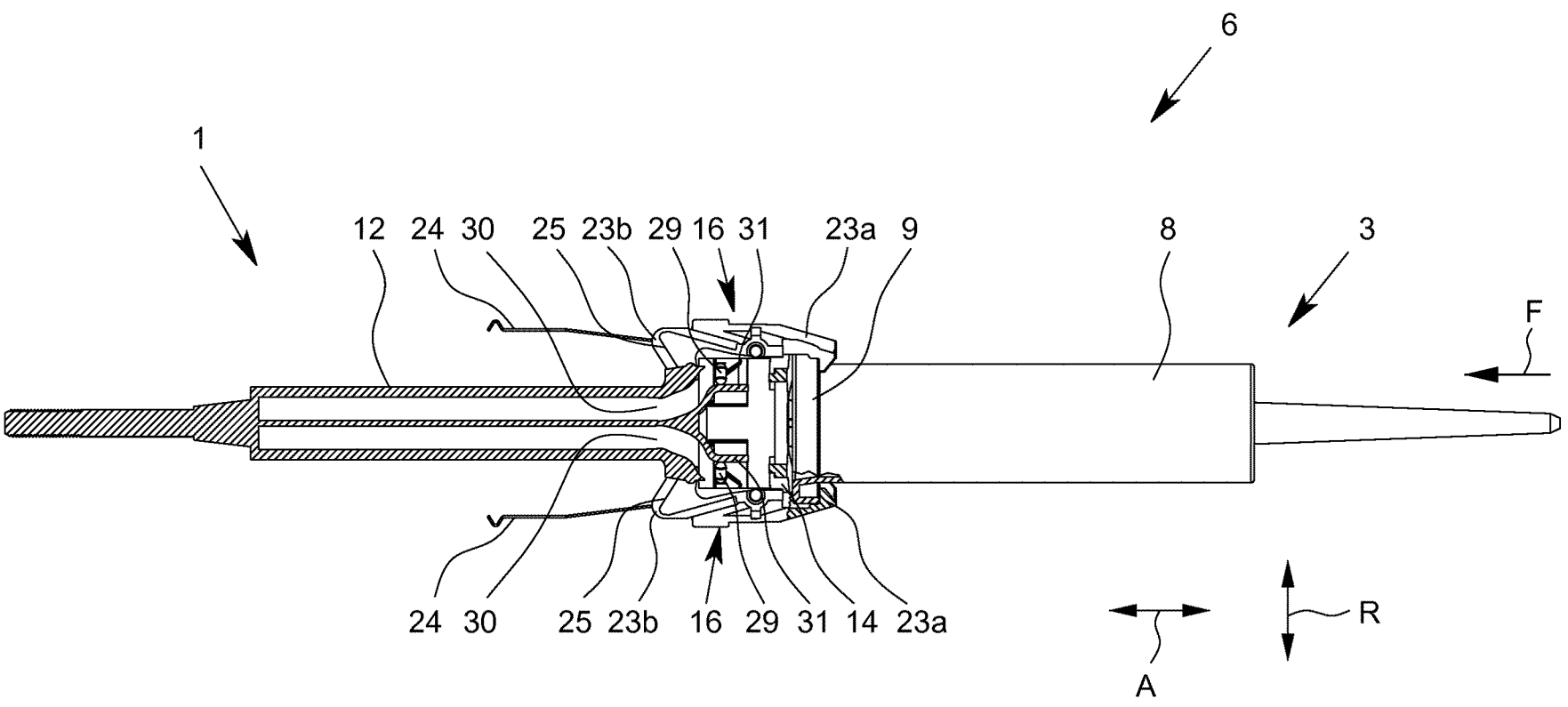
FIG. 6 is a schematic horizontal longitudinal section through the system from FIG. 2, in a second state.

In the case of the preferred exemplary embodiment represented here, the first fastening means 16 has two pivotably mounted cylinder gripping levers 23 that, when the first fastening means 16 is in the fixing position, can engage behind the fastening portion 9 of the cylinder 8. The cylinder gripping levers 23 are each of a two-arm design, having a gripping arm 23*a* and an actuating arm 23*b*, and are pivotably mounted in the connection region of the gripping arm 23*a* and the actuating arm 23*b*. Spring elements 24 act upon the cylinder gripping levers 23 in such a manner that, in the absence of a counteracting force, the gripping arms 23*a* are pivoted radially inward, in particular toward each other. The cylinder gripping levers 23 are arranged and mounted in such a manner that, during mounting of a piston-cylinder unit 3, the gripping arms 23*a* can be forced radially outward by the fastening portion 9 of the cylinder 8 (first state, as shown in FIG. 5), and then automatically engage behind the fastening portion 9 when the fastening portion has been moved far enough in the direction of mounting F. This second state is shown in FIG. 6. The fixing position of the first fastening means 16 can be seen in FIGS. 6 to 14.

Here, the gripping arms 23*a* are arranged such that they are not visible in the vertical longitudinal sections represented. Moreover, the gripping arms 23*a* are curved in cross section, such that, in FIG. 5, in the case of the upper gripping arm 23*a* that is not represented in section, it appears that this upper gripping arm 23*a* is not forced far enough radially outward. In fact, here in each case an inner side of the respective gripping arm 23*a* extends along the outer side of the fastening portion 9, there being no need for the inner side of the respective gripping arm 23*a* to completely abut on the outer side of the fastening portion 9.

For the purpose of moving the first fastening means 16 from its fixing position into its release position by moving the locking element 12 in the direction of mounting F, the actuating arms 23*b* of the cylinder gripping levers 23 of the first fastening means 16 each have a guide contour, in or on which in each case a cam 26 of the locking element 12 can engage when the locking element 12 is moved, in the direction of mounting F, into the release position. The guide contours 25 are realized and arranged such that, during moving of the locking element 12 in the direction of mounting F, the actuating arms 23*b* are moved radially inward by means of the cams 26. The gripping arms 23*a* are thereby moved radially outward.

To facilitate automatic release and/or separation of a piston-cylinder unit 3, the dispenser 1 and its reset means 18 are realized such that a piston-cylinder unit 3 mounted on the dispenser 1 can be separated from the dispenser 1, by means of the reset means 18, after the first fastening means 16 has been moved out of its fixing position and into its release position, and the piston-cylinder unit 3 has been released. For this purpose, the dispenser 1 and its reset means 18 are realized such that the spring element 19 can decompress when the fastening means 16 is in the release position, and separation of the piston-cylinder unit 3 from the dispenser 1 is not prevented.

In the case of the preferred exemplary embodiment represented here, the dispenser 1 has a second fastening means 27, which serves to fix the piston 7 to the dispenser 1. The second fastening means 27 can be moved into a fixing position in which the piston 7 is releasably connected to the piston actuator 10 of the dispenser 1 in such a manner that, for the purpose of taking up and/or dispensing volumes of fluid, the piston 7 can be moved relative to the cylinder 8, between a retracted position and an extended position, by means of the piston actuator 10. This fixing position of the second fastening means 27 is represented in FIGS. 9, 10, 12 and 13.

For this purpose, the second fastening means 27 has two pivotably mounted piston gripping levers 28, by means of which the piston 7 can be gripped during moving of the second fastening means 27 into its fixing position. Each piston gripping lever 28 here has a cutting roller, having five cutting elements formed on the cutting roller which, when the piston gripping lever 28 is moved into the fixing position, grip on the piston and partly penetrate the piston 7.

In the case of the preferred exemplary embodiment represented here, as a result of the locking element 12 being moved in the axial direction A, the second fastening means 27 can be moved from its fixing position into a release position and vice versa, the piston 7 not being connected to the piston actuator 10 when the second fastening means 27 is in the release position. For this purpose, each piston gripping lever 28 has a positioning head 28, and the locking element 12 has a matching guide contour 30 and an axial extension 31. The piston gripping levers 28 can be pivoted by means of the positioning heads 29. During moving of the locking element 12 and/or of the piston actuator 10, each positioning head 29 is guided on the guide contour 30 of the locking element 12.

When the second fastening means 27 is in the fixing position, both positioning heads 29 are guided in the guide contour 30, in particular each in a separate portion between two walls of the guide contour 30. In the release position, both positioning heads 29 abut on the axial extension 31 and the housing 2, and are further apart from each other than in the fixing position.

Figure 8:
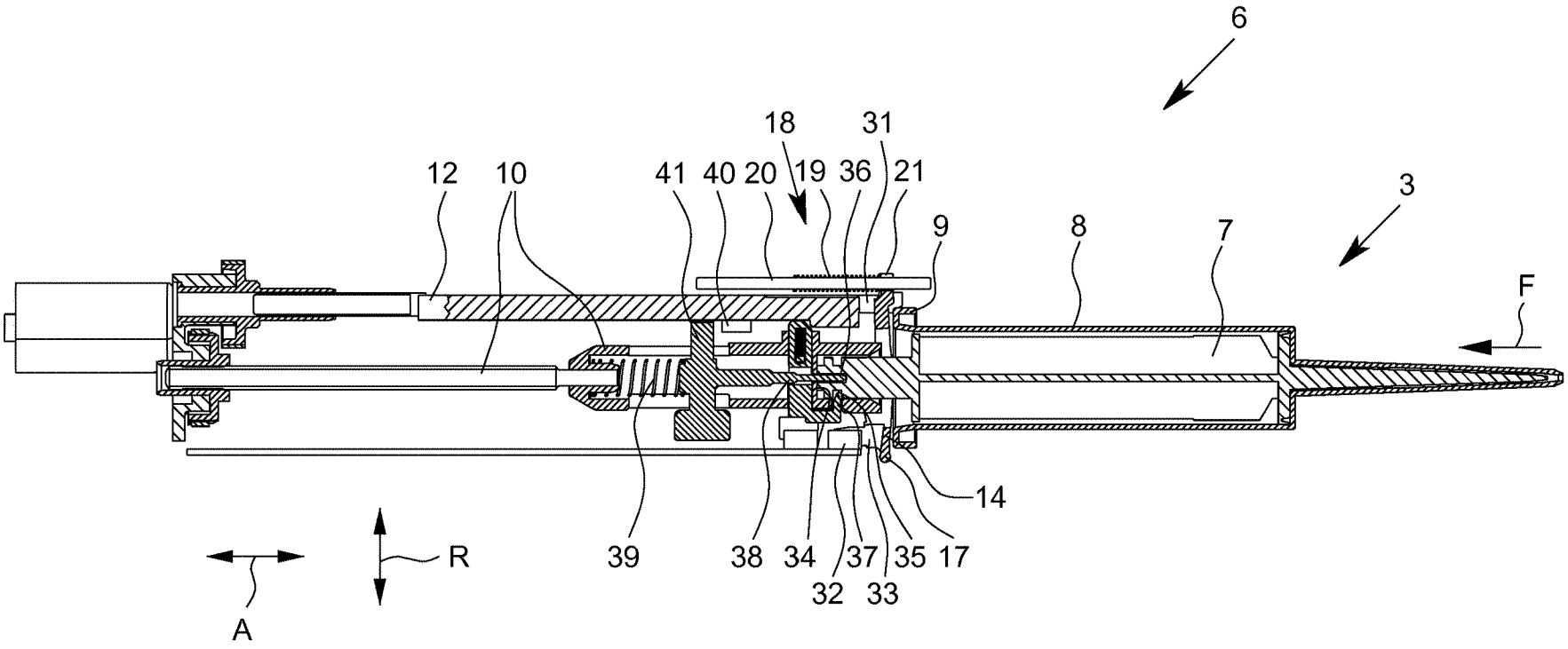
FIG. 8 is a schematic vertical longitudinal section through the system from FIG. 2, in a fourth state.
Figure 9:
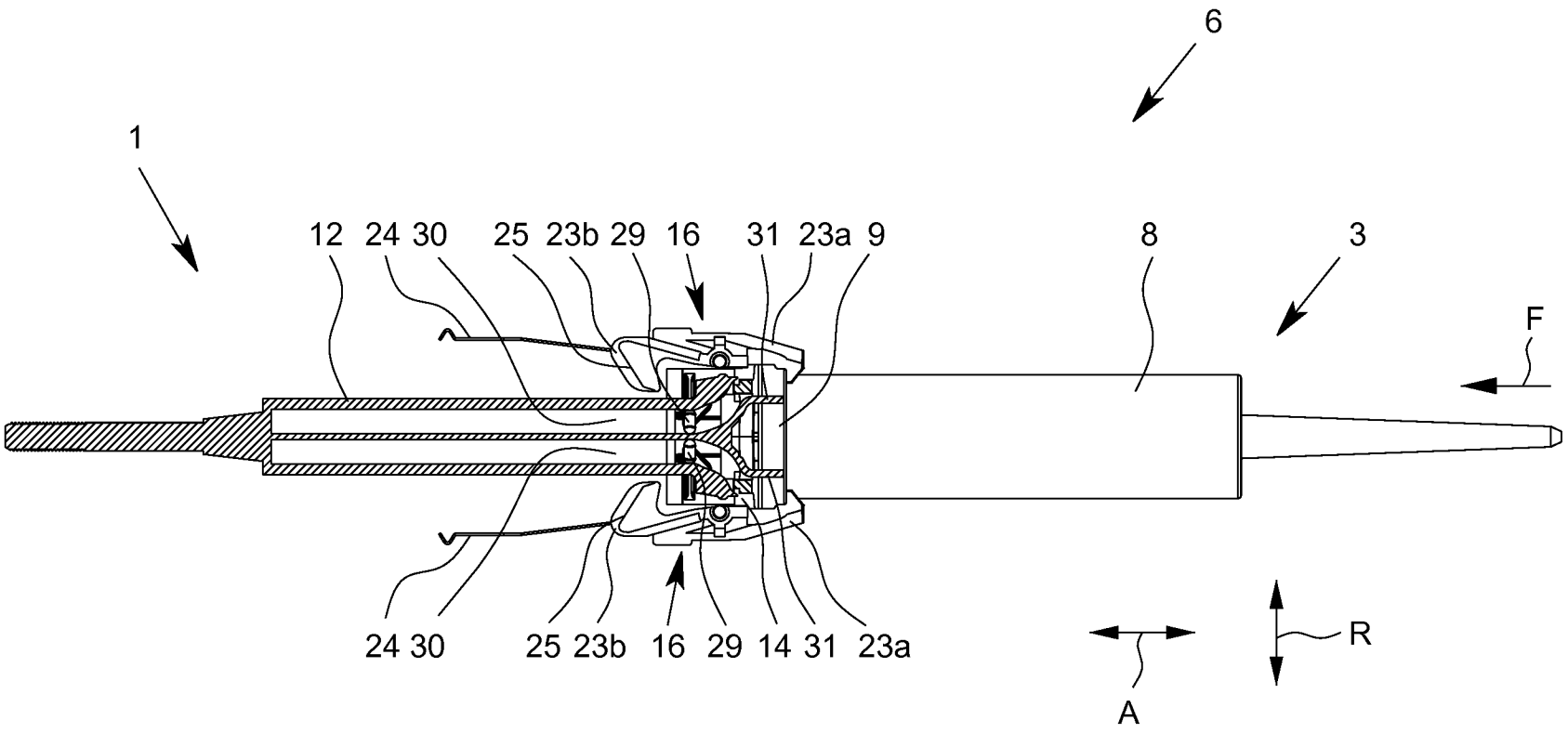
FIG. 9 is a schematic horizontal longitudinal section through the system from FIG. 2, in a fifth state.

If the second fastening means 27 is in its release position (FIG. 8) and the locking element 12 is then moved, counter to the direction of mounting F, from its initial position into a second intermediate position, the positioning heads 29 are guided along the axial extension 31 and the housing 2 into the guide contour 30, specifically each positioning head 29 being guided into its own portion of the guide contour 30. The positioning heads 29 in this case are moved toward each other. As a result, the piston gripping levers 28 are moved onto the piston 7 until they grip, or fix, the piston 7, in particular by their cutting rollers. The second fastening means 27 is then in its fixing position (FIG. 9).

In the case of the preferred exemplary embodiment represented here, the second fastening means 27 is motionally coupled to the piston actuator 10, and in its fixing position can be guided, over the entire travel that it can execute during moving of the piston actuator 10, by the locking element 12 in such a manner that it remains in its fixing position. In particular, the extent of the guide contour 30 in the axial direction A is greater than the stroke that can be executed by the piston actuator 10.

If the piston 7 is in its retracted position and the second fastening means 27 is in its fixing position, and if the locking element 12 is then moved, in the direction of mounting F, from the second position into a first intermediate position, the positioning heads 29 are guided along the guide contour 30 and finally out of the latter, such that the positioning heads 29 are guided between the axial extension 31 and the housing 2. The positioning heads 29 in this case are moved apart from each other, or at a distance from each other. As a result, the piston gripping levers 28 are moved away from the piston 7, such that the piston 7 is no longer fixed. The second fastening means 27 is then in its release position.

The axial extension 31 fulfills a further purpose, namely, it delimits the travel of the locking element 12 when the latter is moved, counter to the direction of mounting F, into its locking position without there being a piston-cylinder unit mounted on the dispenser 1. In this case, owing to the absence of the cylinder 8, the stop element 14 has no counter-stop. In order to prevent damage and ensure operational reliability, the axial extension 31 is realized and arranged such that, when the locking element 12 comes against the stop element 14, it comes against a stop of the housing 2, as a result of which the locking element 12, and thus the stop element 14, cannot be moved further counter to the direction of mounting F.

In the case of the preferred exemplary embodiment represented here, the dispenser 1 has means for optically sensing the mounting of a piston-cylinder unit 3 on the dispenser 1. These means comprise a light barrier 32 having a light-beam source and a sensor for detecting light beams of the light-beam source, the light beam 32 being arranged such that moving of the stop element 14 in the axial direction A can be detected by the light barrier 32. For this purpose, the stop element 14 has a web 33, which is moved synchronously with the stop element 14. When the stop element 14 is moved, or pressed, far enough in the direction of mounting F, the web 33 interrupts the light barrier 32. Without force being applied to the stop element 14, in the direction of mounting F, the stop element 14 is in its initial position, in which the light barrier 32 is not interrupted by the web 33. The dispenser 1 can thus ascertain whether or not a piston-cylinder unit 3 has been mounted on the dispenser 1. This sensing enables further steps to be triggered, e.g., moving of the locking element 12.

Figure 7:
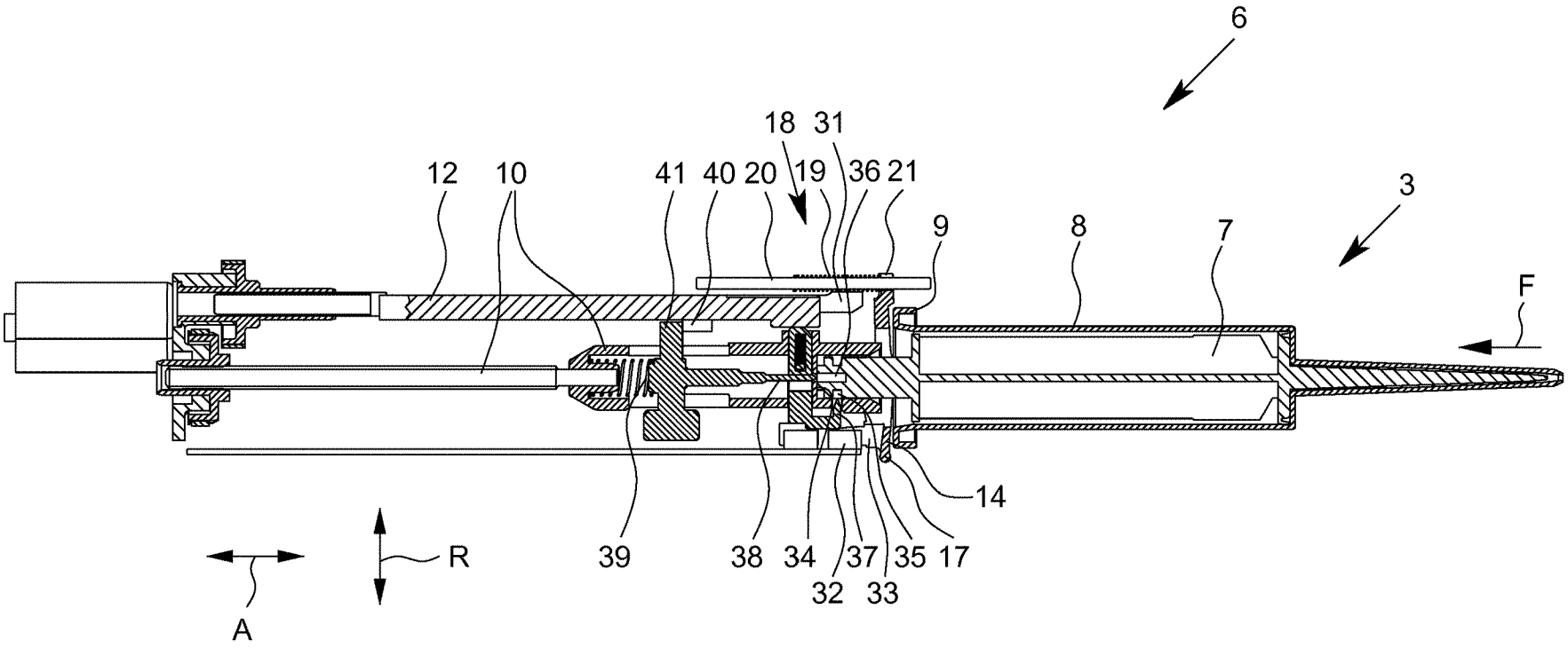
FIG. 7 is a schematic vertical longitudinal section through the system from FIG. 2, in a third state.

In the case of the preferred embodiment represented, for the purpose of acquiring a piston-side reference point, the piston actuator 10 can be moved onto the piston 7, until a stop 34 of the piston actuator 10 abuts on an end face of the piston 7. This third state is shown in FIG. 7. The absolute position of this piston-side reference point can be determined by means of a position determining means.

In the case of the preferred embodiment represented, the dispenser 1 has an acquisition device for automatically identifying the type of a piston-cylinder unit 3 mounted on the dispenser 1. The acquisition device has a radial information reader, by means of which information of a radially oriented information carrier portion 35 of the piston-cylinder unit 3 can be acquired. In addition, the acquisition device has an axial information reader, by means of which information of an axially oriented information carrier portion 36 of the piston-cylinder unit 3 can be acquired.

The radially oriented information carrier portion 35 is realized hear as a radially oriented recess in the piston 7, and the axially oriented information carrier portion 36 is realized as an axially oriented recess in an end face of the piston 7.

As a result of the locking element 12 moving out of the first intermediate position and into the second intermediate position, at least a part of the radial information reader, namely a projection 37, can be inserted into the radially oriented recess 35, in the radial direction R. As a result of the locking element 12 moving out of its initial position and into the first intermediate position, at least a part of the axial information reader can be inserted into the axially oriented recess 36, in the axial direction A. In particular, the axial information reader has an acquisition element 38 that can be inserted, at least partly, into the axially oriented recess 36, in the axial direction A. The depth of the axially oriented recess 36 can be determined by the position determining means. The type of the piston-cylinder unit 3 can be identified, at least partly, on the basis of the thus determined depth of the recess 36.

The previously determined piston-side reference point marks the starting point of a determination of the depth of the axially oriented recess 36.

Here, the acquisition element 38 is elastically biased, by means of a spring 39, counter to the direction of mounting F. By means of the locking element 12, moved from the first intermediate position into its initial position, the acquisition element 38 can be moved into a release position, and held there. The locking element 12 holds the acquisition element 38 in its release position in that a driver 40 of the locking element 12, on an extension 41 of the acquisition element 38, counteracts the force of the spring 39 and blocks a movement of the acquisition element 38 in the direction of the spring force (thus, counter to the direction of mounting F).

As a result of the locking element 12 being displaced, counter to the direction of mounting F, from its initial position into the first intermediate position, a movement of the acquisition element 38 is no longer blocked, such that the acquisition element 38 is pressed by the spring 39 onto the piston 7, and then into the axially oriented recess 36, until the acquisition element 38 comes to the end of the axially oriented recess 36, and is blocked there. This fourth state is shown in FIG. 8.

Here, the axially oriented recess 36 is open upwardly in the axial direction A. The recess 36 is realized here in the form of a groove. It is thus not a cylindrical hole enclosed in the radial direction R. Instead, in the radial direction R the recess 36 is partly open outwardly, specifically along the entire depth of the recess 36.

The dispenser 1 has further means, including an electronic control means, a gear unit, an electric power supply means, an indicating means and an input means.

Described in the following is a preferred sequence of a method for releasably mounting a piston-cylinder unit 3 on the dispenser 1.

At the start of the method, the locking element 12 is in its initial position.

Firstly, the fastening portion 9 of the cylinder 8 of the piston-cylinder unit 3 is placed against the stop element 14 of the dispenser 1, by means of a movement at least substantially in the axial direction A, typically manually by a user. The piston 7 is thereby moved through the passage opening 15 of the stop element 14. In addition, the gripping arms 23*a* of the cylinder gripping levers 23 are forced radially outward by the fastening portion 9, such that the gripping arms 23*a* slide along the fastening portion 9. This first state is shown in FIG. 5.

In order not to impede further pressing of the piston-cylinder unit 3, before placement of the latter the piston actuator 10 was moved into a release position.

Following placement, the cylinder 8 is moved further relative to the housing 2, in the direction of mounting F. The stop element 14 is thereby forced counter to the resetting force of the reset means 18, in the direction of mounting F. The spring element 19 of the reset means 18 is thereby compressed.

When the cylinder 8 has been moved far enough in the direction of mounting F, the gripping arms 23*a* engage behind the fastening portion 9, whereby the first fastening means 16 is moved into its fixing position, as a result of which the cylinder 8 is fixed to the dispenser 1, such that a relative movement between the cylinder 8 and the housing 2 is blocked counter to the direction of mounting F and in the radial direction R. This second state is shown in FIG. 6.

The moving of the stop element 14 in the direction of mounting F is detected optically by means of the light barrier 32. The piston actuator 10 is thereupon moved, counter to the direction of mounting F, onto the piston 7, until the stop 34 of the piston actuator 10 abuts on an end face of the piston 7. This third state is shown in FIG. 7. The distance travelled by the piston actuator 10 is determined. A reference point on the piston is thereby acquired, which represents, as it were, a distance calibration that renders the method at least largely non-dependent on differences in the dimensional tolerances of the parts of the piston-cylinder unit 3.

The locking element 12 is then moved automatically, counter to the direction of mounting F, into the first intermediate position. As a result, the acquisition element 38 is no longer blocked by the locking element 12, and is inserted, at least partly into the axially oriented recess 36 in the axial direction A. This fourth state is shown in FIG. 8. The depths of this recess 36 is determined, and the determined depth value is used to identify the type of the piston-cylinder unit 3.

The locking element 12 is then automatically moved further, counter to the direction of mounting F, into the second intermediate position. As a result, the second fastening means 27 is moved with its piston gripping levers 28 into its fixing position, in which the piston 7 is releasably connected to the piston actuator 10 in such a manner that the piston 7 can be moved relative to the cylinder 8, by means of the piston actuator 10, for the purpose of taking up and dispensing volumes of fluid. This fifth state is shown in FIG. 9. At the same time, the projection 37 of the radial information reader is inserted into the radially oriented recess 35.

Figure 10:
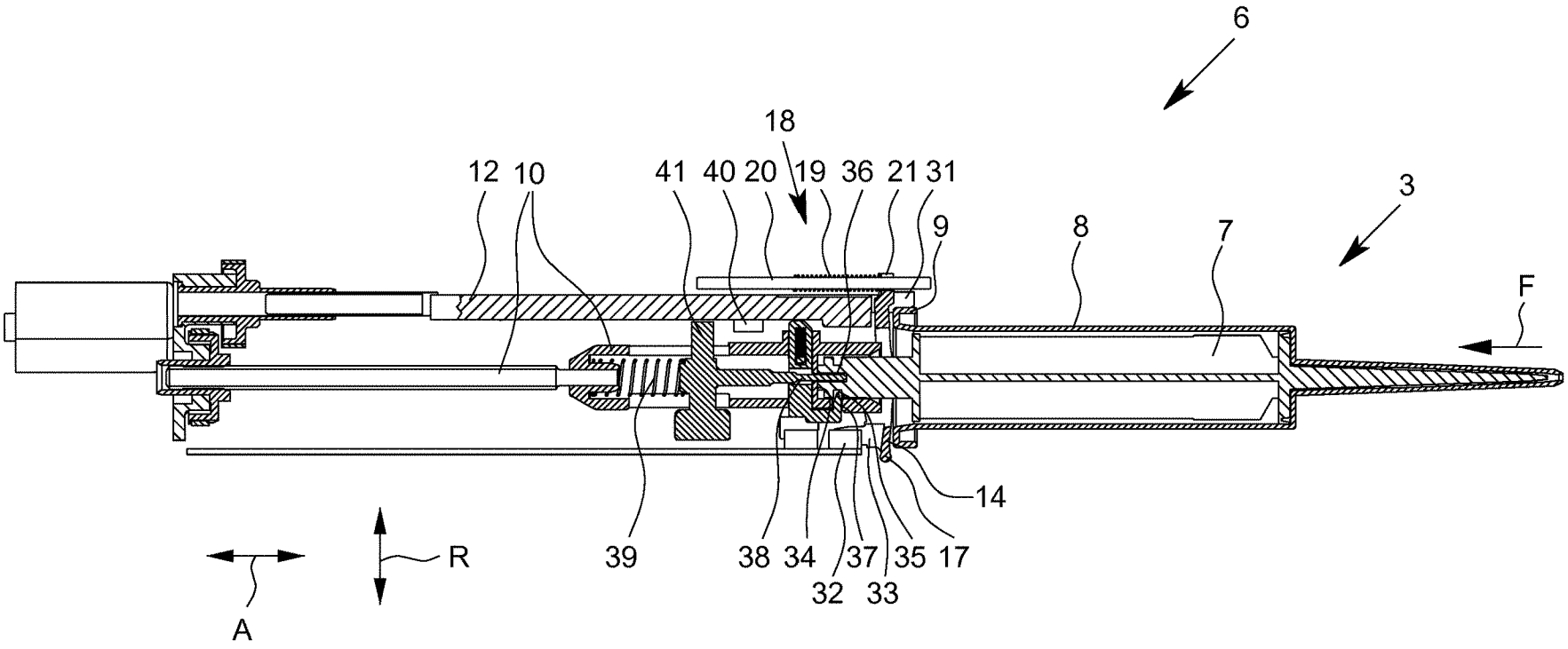
FIG. 10 is a schematic vertical longitudinal section through the system from FIG. 2, in a sixth state.

The locking element 12 is then automatically moved further counter to the direction of mounting F, into its locking position. This sixth state is shown in FIG. 10. In this case, the fastening portion 9 of the cylinder 8 is clamped between the cylinder gripping levers 23 and the stop element 14, such that a relative movement between the cylinder 8 and housing 2 is blocked in the axial direction A and in the radial direction R and in the circumferential direction.

A relative movement between the piston 7 and the cylinder 8 can now be effected, by means of the piston actuator 10, for the purpose of taking up or dispensing a volume of fluid.

To release the piston-cylinder unit 3 mounted on the dispenser 1, the piston actuator 10 is moved such that the piston 7 is in its retracted position. The locking element 12 is then moved, in the direction of mounting F, out of its locking position and, via the second intermediate position and the first intermediate position, into its initial position. As a result, the second fastening means 27 is moved out of its fixing position and into its release position. The piston 7 is now no longer connected to the piston actuator 10. In addition, the projection 37 of the radial information reader is moved out of the radially oriented recess 35, and the acquisition element 38 is moved out of the axially oriented recess 36.

The locking element 12 is automatically moved further, in the direction of mounting F, into the release position. As a result, the first fastening means 16 is moved out of its fixing position and into its release position. This seventh state is shown in FIG. 11. The relative movement between the cylinder 8 and the housing 2 can now be executed unimpeded, counter to the direction of mounting F.

The resetting force of the reset means 18 upon the stop element 14, in particular the decompressing of the spring element 19, causes the piston-cylinder unit 3 to be separated from the dispenser 1. The movement of the stop element 14 initiated by the spring element 19, in the axial direction A, is detected by the light barrier 32.

The locking element 12 is moved automatically into its initial position, and the piston actuator 10 is moved into its initial position, such that the described sequence can recommence with the mounting of a piston-cylinder unit 3.

What is claimed is:

1. A dispenser for taking up and dispensing volumes of fluid, comprising:

a dispenser housing, a piston-cylinder unit having a piston and a cylinder which is releaseably mountable by a movement at least substantially in an axial direction of the dispenser housing, wherein a piston actuator for moving the piston relative to the cylinder, the piston actuator being arranged in a movable manner in the dispenser housing, a first drive for moving the piston actuator, and a locking element which is arranged in a movable manner in the dispenser housing and is driven by means of a second drive.

2. The dispenser as claimed in claim 1, wherein the second drive moves the locking element parallel to the piston actuator via a self-arresting gear unit.

3. The dispenser as claimed in claim 1, wherein the dispenser has means for optically detecting mounting of a piston-cylinder unit on the dispenser housing.

4. The dispenser as claimed in claim 1, further comprising:

cylinder fixing levers for fixing the cylinder to the dispenser housing, wherein the cylinder fixing levers are movable into a fixing position in which the cylinder fixing levers block relative movement between the cylinder and the dispenser housing, counter to the direction of mounting, and wherein, when the locking element is moved by the second drive, the cylinder fixing levers are movable into a release position in which a relative movement between the cylinder and the dispenser housing can be executed counter to the direction of mounting.

5. The dispenser as claimed in claim 1, further comprising:

an acquisition device for automatically identifying the type of a piston-cylinder unit mounted on the dispenser, the acquisition device has a radial information reader, by means of which information of a radially oriented information carrier portion of the piston-cylinder unit can be acquired, and at least a part of the radial information reader is movable as a result of moving of the locking element.

6. The dispenser as claimed in claim 1, further comprising:

an acquisition device for automatically identifying the type of a piston-cylinder unit mounted on the dispenser, the acquisition device has an axial information reader, by means of which information of an axially oriented information carrier portion of the piston-cylinder unit can be acquired, and at least a part of the axial information reader is movable as a result of moving of the locking element.

7. The dispenser as claimed in claim 6, wherein, as a result of moving of the locking element, at least a part of the radial information reader is insertable in the radial direction into a radially oriented recess on a piston head of the piston-cylinder unit.

8. The dispenser as claimed in claim 6, wherein, as a result of moving of the locking element, at least a part of the axial information reader is insertable in the axial direction into an axially oriented recess in an end face of a piston head of the piston-cylinder unit.

9. The dispenser as claimed in claim 1, wherein the dispenser comprises the following:

a stop element, which is movable at least substantially in the axial direction, relative to the dispenser housing, and can be pressed relative to the dispenser housing at least partly in a direction of mounting, wherein a fastening portion of the cylinder is abuttable on the stop element during mounting of the piston-cylinder unit on the dispenser, and cylinder fastening levers for fixing the cylinder on the dispenser, the cylinder fastening levers being movable into a fixing position in which the cylinder fastening levers block relative movement between the cylinder and the dispenser housing counter to the direction of mounting, and wherein the locking element is movable into a locking position in which the locking element blocks relative movement between the stop element and the dispenser housing, in the direction of mounting.

10. The dispenser as claimed in claim 9, wherein, when the locking element is in the locking position, a fastening portion of the cylinder is clampable between the cylinder fastening levers and the stop element, in such a manner that a relative movement between the cylinder and the dispenser housing is blocked in at least one of the axial direction, a radial direction or a circumferential direction.

11. The dispenser as claimed in claim 9, further comprising a sensor means for detecting moving of the stop element in the axial direction by means of a light barrier arranged in the dispenser, wherein the light barrier has a light-beam source and a sensor for detecting light beams of the light-beam source.

12. The dispenser as claimed in claim 9, wherein the dispenser has a reset means which exerts a resetting force upon the stop element, at least substantially in the axial direction, counter to the direction of mounting.

13. The dispenser as claimed in claim 11, wherein the piston-cylinder unit mounted on the dispenser can be separated from the dispenser by means of the reset means.

14. The dispenser as claimed in claim 1, further comprising:

piston fixing levers for fixing the piston to the dispenser housing, and wherein the piston fixing levers are movable into a fixing position in which the piston is releasably connected to the piston actuator in such a manner that the piston is movable relative to the cylinder, by means of the piston actuator, for at least one of taking up or dispensing volumes of fluid, and wherein the piston fixing levers, as a result of moving of the locking element, are movable from the fixing position to and from a release position, and wherein the piston is disconnected from the piston actuator when the piston fixing levers are in said release position.

15. The dispenser as claimed in claim 14, wherein the piston fixing levers are movably coupled to the piston actuator and in said fixing position, are guidable by the locking element, during the moving of the piston actuator in such a manner that it remains in said fixing position.

16. The dispenser as claimed in claim 14, wherein the piston fixing levers comprise two pivotably mounted piston gripping levers with cutting rollers, and wherein the piston is grippable by the piston gripping levers during moving of the piston fixing levers into said fixing position.

17. The dispenser as claimed in claim 16, wherein each piston gripping lever has a positioning head by means of which the respective piston gripping lever can be pivoted, and wherein, during moving of at least one of the locking element or the piston actuator, each positioning head is guided on a guide contour of the locking element.

18. The dispenser as claimed in claim 17, wherein the guide contour has a greater stroke length in the axial direction than executable by the piston actuator.

19. A method for releasably mounting a piston-cylinder unit on a dispenser, wherein the piston-cylinder unit has a piston and a cylinder that has a fastening portion, and the dispenser has a housing, a stop element, first levers for fixing the cylinder to the dispenser, and a locking element, wherein the method comprises the following method steps:

a) placing the fastening portion of the cylinder of the piston-cylinder unit against the stop element of the dispenser by a movement at least substantially in an axial direction of the dispenser, b) moving the first levers of the dispenser into a fixing position in which the cylinder of the piston-cylinder unit is fixed to the dispenser by the first levers of the dispenser, such that a relative movement between the cylinder of the piston-cylinder unit and the housing of the dispenser counter to a direction of mounting, and is blocked, and c) moving the locking element by means of a drive.

20. The method as claimed in claim 19, wherein the dispenser has an acquisition device for automatically identifying the type of piston-cylinder unit mounted on the dispenser, wherein the acquisition device has a radial information reader for acquiring information of a radially oriented information carrier portion of the piston-cylinder unit, and wherein, in step c), at least a part of the radial information reader is radially insertable into a radially oriented recess on a piston head of the piston-cylinder unit.

21. The method as claimed in claim 19, wherein the dispenser has an acquisition device for automatically identifying the type of a piston-cylinder unit mounted on the dispenser, wherein the acquisition device has an axial information reader for acquiring information of an axially oriented information carrier portion of the piston-cylinder unit, and wherein, in step c), as a result of moving of the locking element, at least a part of the axial information reader is insertable in the axial direction into a recess in an end face of a piston head of the piston-cylinder unit.

22. The method as claimed in claim 19, wherein, in step a), moving of the stop element in the direction of mounting is detected at least one of mechanically, electronically, inductively or optically.

23. The method as claimed in claim 19, wherein, in step c), automatically following detection of movement of the stop element in the direction of mounting, the locking element is moved into a locking position in which relative movement between the stop element and the housing in the direction of mounting is blocked.

24. The method as claimed in claim 23, wherein, when the locking element is in the locking position, the fastening portion of the cylinder is clamped between the first levers and the stop element, such that a relative movement between the cylinder and the housing in the axial direction, and optionally in the radial direction (R) and/or circumferential direction, is blocked.

25. The method as claimed in claim 19, wherein, in step c), for the purpose of fixing the piston to the dispenser, as a result of moving of the locking element, second levers of the dispenser are moved into a fixing position in which the piston is releasably connected to a piston actuator of the dispenser in such a manner that, for the purpose of at least one of taking up or dispensing volumes of fluid, the piston is moved relative to the cylinder by driving the piston actuator.

26. A method for releasing a piston-cylinder unit mounted on the dispenser, wherein the piston-cylinder unit has a piston and a cylinder, and the dispenser has a housing, cylinder fixing levers for fixing the cylinder to the dispenser, and a locking element wherein the method comprises the following method steps:

moving the locking element by means of a drive, moving the first levers out of a fixing position, in which the cylinder fixing levers block a relative movement between the cylinder and the housing counter to the direction of mounting, into a release position, in which a relative movement between the cylinder and the housing counter to the direction of mounting can be executed, and moving the cylinder relative to the housing counter to the direction of mounting.

27. The method as claimed in claim 26, wherein, as a result of the moving of the locking element, piston fixing levers of the dispenser are moved out of a fixing position, in which the piston is releasably connected to a piston actuator of the dispenser in such a manner that, for the purpose of at least one of taking up or dispensing volumes of fluid, the piston is moved relative to the cylinder by the piston actuator into a release position in which the piston is disconnected from the piston actuator.

* * * * *